US012459716B2

(12) United States Patent
Crosby et al.

(10) Patent No.: US 12,459,716 B2
(45) Date of Patent: Nov. 4, 2025

(54) BAG-IN-BOX DISPENSING SYSTEM AND METHOD ASSOCIATED

(71) Applicant: GBS Holdings LLC, Oak Ridge, TN (US)

(72) Inventors: Bryan Justin Robert Crosby, Knoxville, TN (US); Ammar Eli Altawil, Knoxville, TN (US)

(73) Assignee: GBS HOLDINGS LLC, Oak Ridge, TN (US)

( * ) Notice: Subject to any disclaimer, the term of this patent is extended or adjusted under 35 U.S.C. 154(b) by 342 days.

(21) Appl. No.: 17/754,594

(22) PCT Filed: Oct. 30, 2020

(86) PCT No.: PCT/US2020/058243
§ 371 (c)(1),
(2) Date: Apr. 6, 2022

(87) PCT Pub. No.: WO2021/087280
PCT Pub. Date: May 6, 2021

(65) Prior Publication Data

US 2024/0083653 A1 Mar. 14, 2024

Related U.S. Application Data

(60) Provisional application No. 62/928,850, filed on Oct. 31, 2019.

(51) Int. Cl.
*B65D 77/06* (2006.01)
*B65D 5/54* (2006.01)

(52) U.S. Cl.
CPC ..... *B65D 77/067* (2013.01); *B65D 5/541* (2013.01)

(58) Field of Classification Search
CPC ..... B65D 77/067; B65D 5/541; B65D 77/061
See application file for complete search history.

(56) References Cited

U.S. PATENT DOCUMENTS 3,173,579 A 3/1965 Curie et al.
3,843,021 A 10/1974 Schieser
(Continued)

FOREIGN PATENT DOCUMENTS

FR 3 043 662 A1 5/2017
WO 2019/203917 A1 10/2019

OTHER PUBLICATIONS

International Search Report and Written Opinion, PCT/US2020/058243, dated Mar. 18, 2021 (24 pp.).

*Primary Examiner* — Vishal Pancholi
(74) *Attorney, Agent, or Firm* — Eversheds Sutherland (US) LLP

(57) ABSTRACT

Bag-in-box dispensing systems (1100) are provided which include an outer box (1101) enclosing an inner flexible container (1103), wherein the outer box includes: a top panel (1107); a bottom panel (1105); a first side panel (1125); a second side panel (1127); a first front panel (231, 329) including at least one front perforation (233, 331) configured to allow a user to separate a portion of the front panel, expose the dispensing system, and secure a portion of the dispensing system in the first front panel; a second front panel (243, 343) disposed adjacent to the first front panel and forming an outer surface of the box, wherein the second front panel includes a perforation extending from an edge of the second front panel and allowing a portion of the second front panel to be removed, thereby exposing at least a portion of the first front panel.

24 Claims, 32 Drawing Sheets

(56) References Cited

U.S. PATENT DOCUMENTS

| | | | | |
|---|---|---|---|---|
| 4,426,027 | A * | 1/1984 | Maynard, Jr. | B65D 47/063 222/530 |
| 5,088,632 | A * | 2/1992 | Odet | B65D 47/063 222/530 |
| 9,550,606 | B2 * | 1/2017 | Crosby | B65D 47/0885 |
| 10,919,680 | B1 * | 2/2021 | Philips | B65D 5/746 |
| 2005/0211730 | A1 * | 9/2005 | Smith | B65D 77/067 222/185.1 |
| 2011/0220707 | A1 | 9/2011 | Solimini et al. | |
| 2013/0270307 | A1 * | 10/2013 | Crosby | B65D 51/20 222/530 |
| 2015/0353256 | A1 | 12/2015 | Smith | |
| 2019/0084744 | A1 | 3/2019 | McRae | |

* cited by examiner

BAG-IN-BOX DISPENSING SYSTEM AND METHOD ASSOCIATED

CROSS-REFERENCE TO RELATED APPLICATIONS

This application claims priority to U.S. Provisional Patent Application No. 62/928,850, filed Oct. 31, 2019, which is incorporated herein by reference.

FIELD OF THE DISCLOSURE

This disclosure relates to dispensing systems, in particular bag-in-box dispensing systems.

BACKGROUND

Bag-in-box systems are used in a variety of industries, because they are often easier to ship than flexible containers or molded rigid containers. However, these bag-in-box systems typically have a simple spout dispenser, and can only dispense liquids by placing the spout directly over where the liquid needs to be dispensed, limiting the uses for these containers. To expand the usability of this type of packaging for other types of fluids, such as motor oil, some bag-in-box systems are shipped with an additional external spout. However, this external spout often suffers damage in shipping, and becomes a target for theft once the packages are on store shelves.

Accordingly, improved bag-in-box dispensing systems are needed.

SUMMARY

In one aspect, a bag-in-box dispensing system is provided including: an outer box enclosing an inner flexible container including a fitment, wherein the outer box includes: a top panel; a bottom panel opposite the top panel; a first side panel comprising a top edge, a bottom edge, a front edge, and a back edge; a second side panel opposite the first side panel comprising a top edge, a bottom edge, a front edge, and a back edge; a first front panel comprising at least one front perforation configured to allow a user to separate a portion of the front panel, expose the dispensing system, and secure a portion of the dispensing system in the first front panel; a second front panel disposed adjacent to the first front panel, such that the second front panel forms the outer surface of the box, wherein the first front panel comprises a perforation extending from an edge of the second front panel and configured to allow a portion of the second front panel to be removed, thereby exposing at least a portion of the first front panel; and a first back panel opposite the first and second front panels.

In another aspect, a method of using the bag-in-box dispensing system is provided which includes: separating one or more handle perforations; separating the perforation in the second front panel to expose a portion of the first front panel; separating the substantially circular perforation in the first front panel; separating the first and second flap perforations in the first front panel; removing the fitment of the flexible container from the outer box and placing the fitment in the substantially circular perforation; rejoining the first and second flap perforations, so that the substantially circular perforation may operate to keep the fitment fixed within the outer box; and dispensing a pourable material through the fitment.

DETAILED DESCRIPTION

Figure 1:
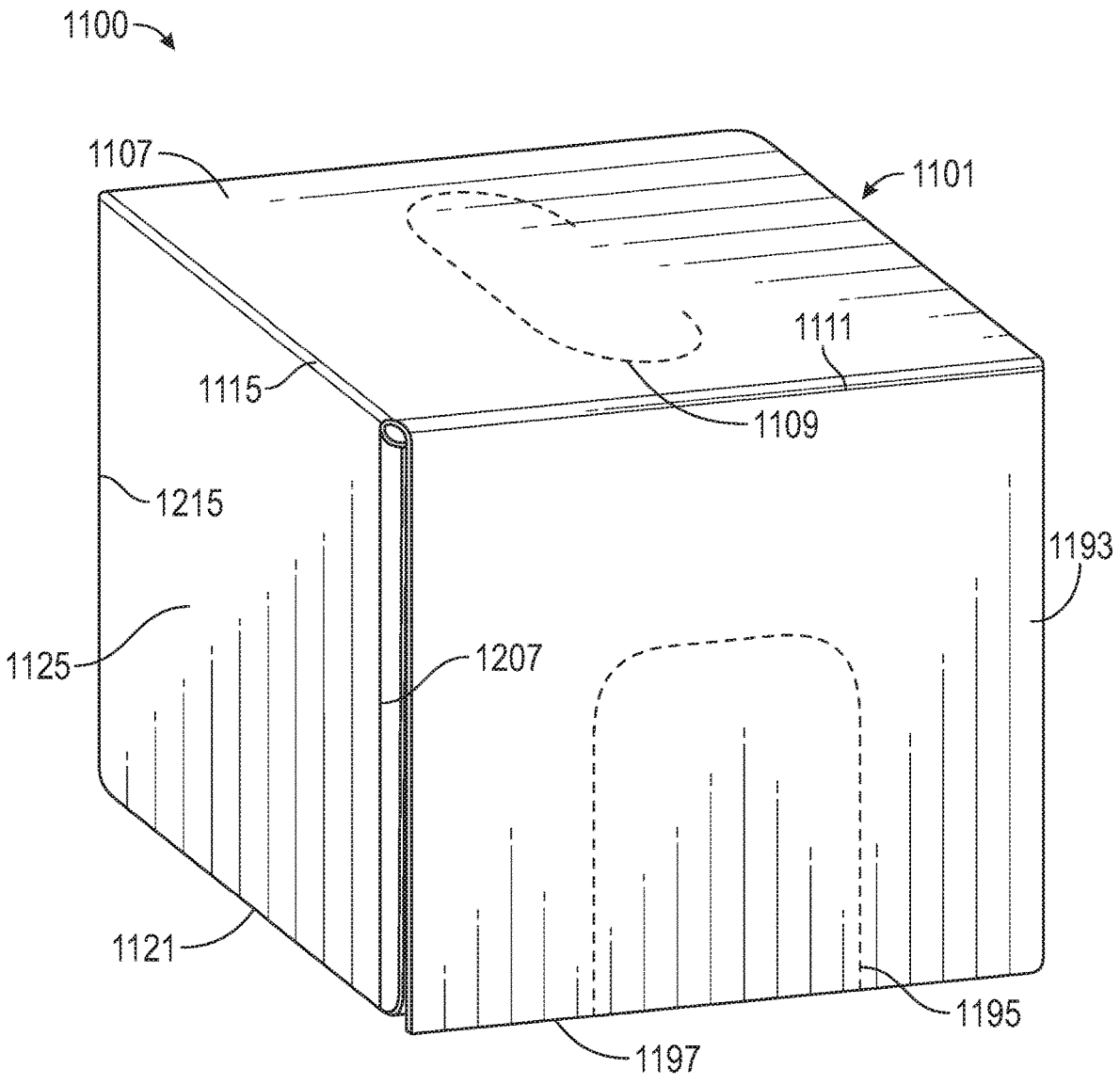
FIG. 1 is a perspective view of a closed bag-in-box dispensing system according to an embodiment of the present disclosure.
Figure 2:
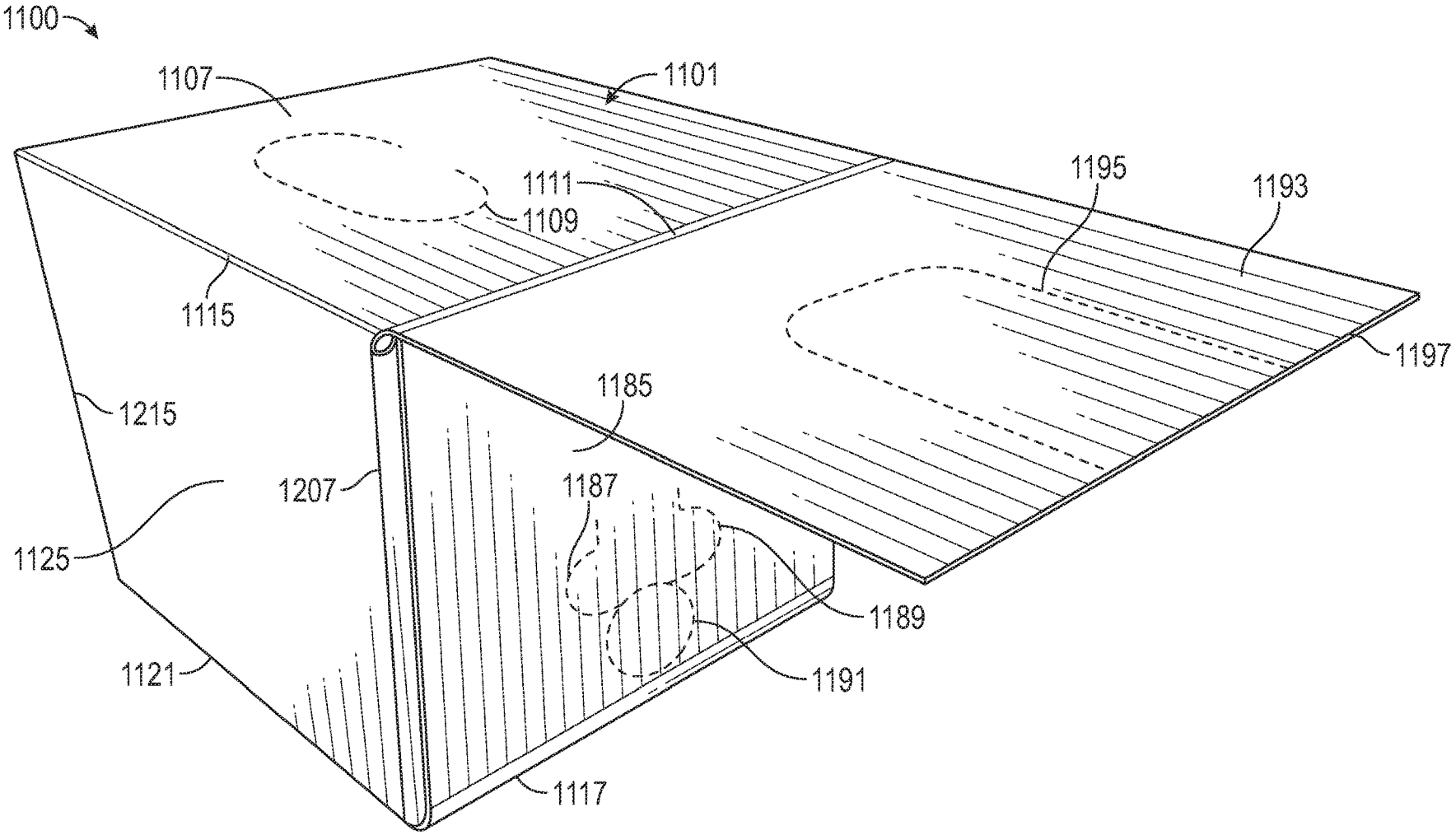
FIG. 2 is a perspective view of the bag-in-box dispensing system of FIG. 1 with an opened second front panel exposing a first front panel.
Figure 3:
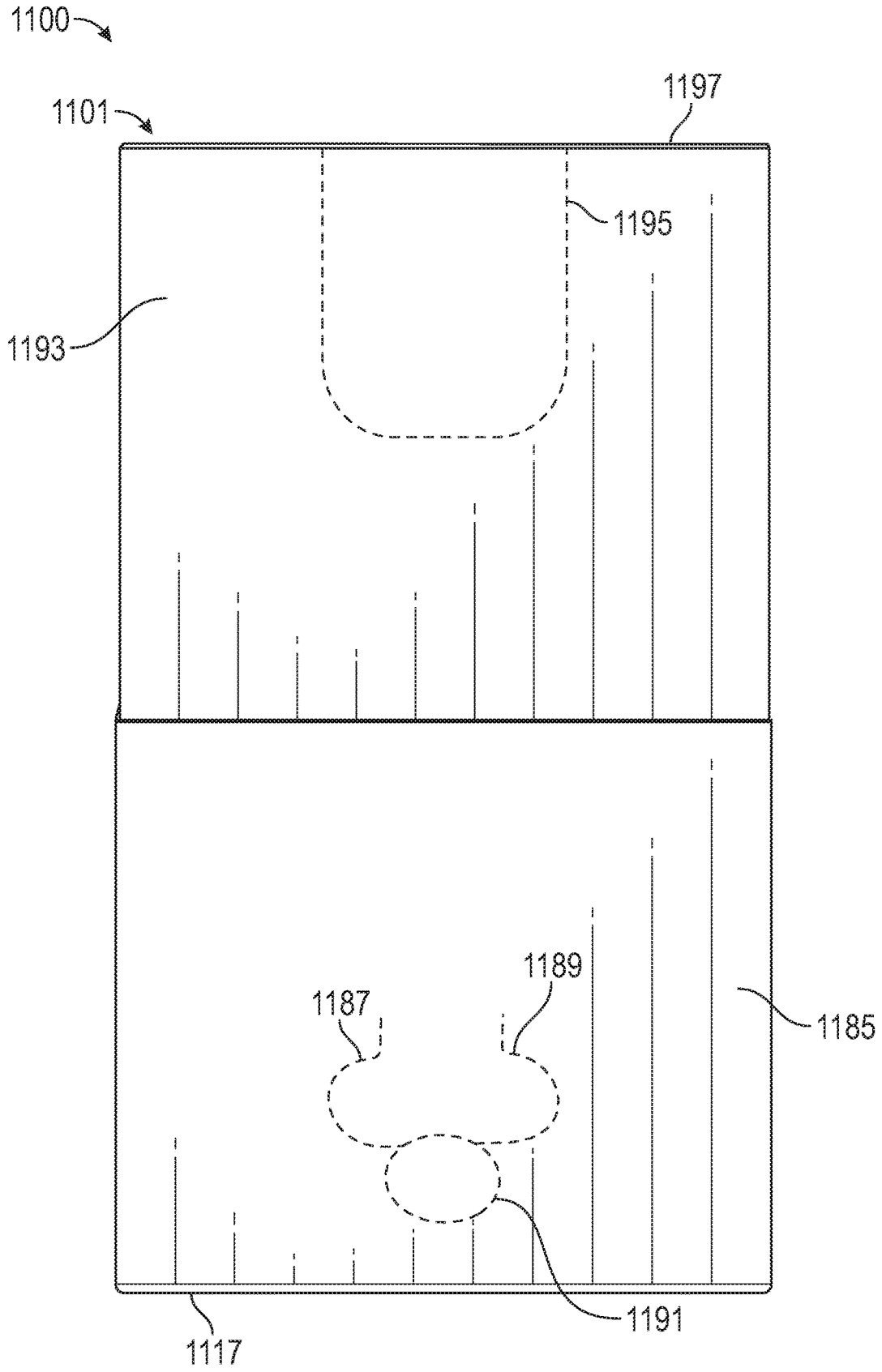
FIG. 3 is a front view of the bag-in-box dispensing system of FIG. 1 with an opened second front panel.
Figure 4:
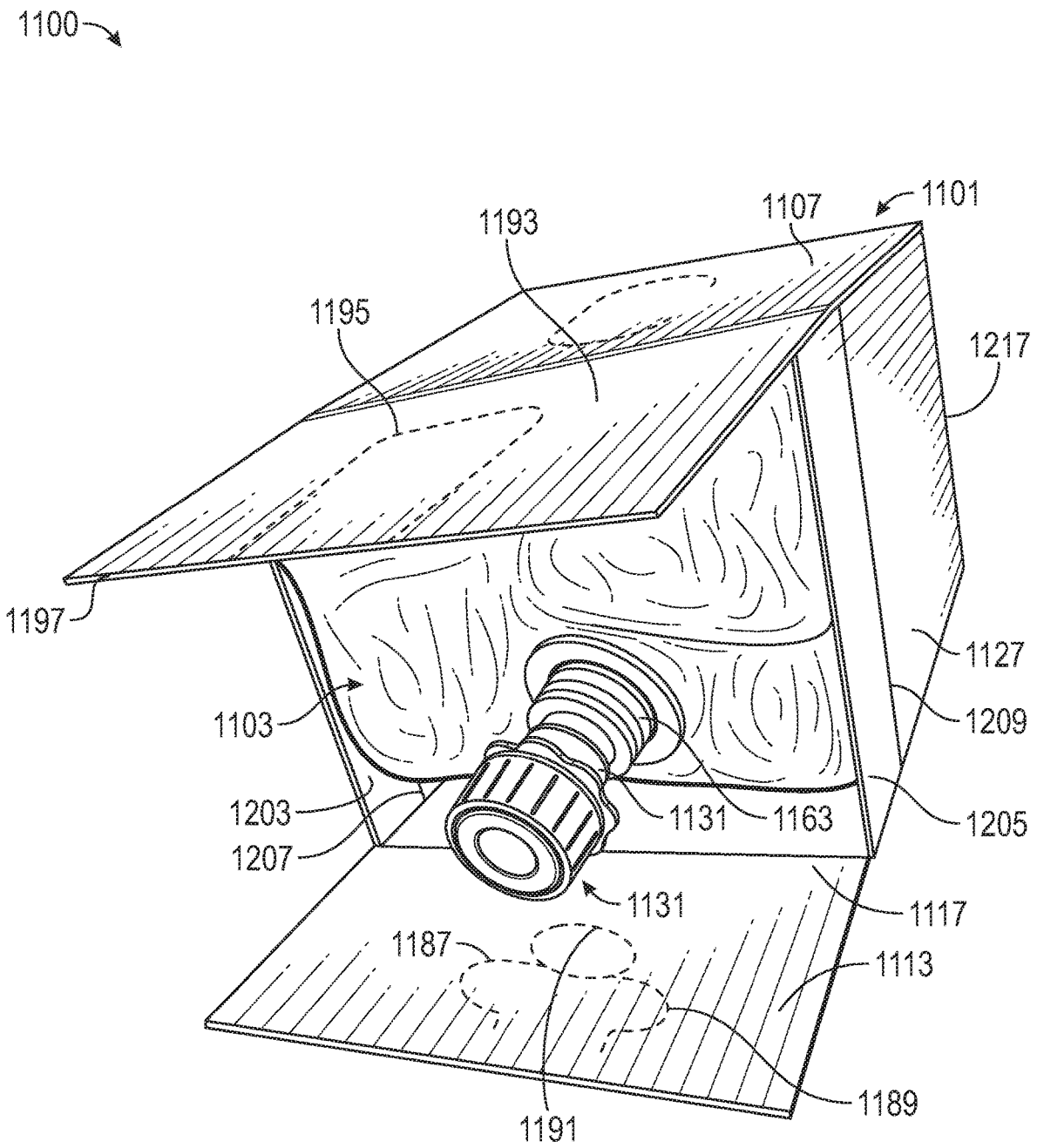
FIG. 4 is a perspective view of the bag-in-box dispensing system of FIG. 1 with an opened first front panel and second front panel.

Improved bag-in-box dispensing systems and methods of using the same are provided herein. In some embodiments, a bag-in-box dispensing system is provided including an outer box enclosing an inner flexible container including a fitment, wherein the outer box comprises: a top panel; a bottom panel opposite the top panel; a first side panel; a second side panel opposite the first side panel; a first front panel comprising at least one front perforation configured to allow a user to separate a portion of the front panel, expose the dispensing system, and secure a portion of the dispensing system in the first front panel; a second front panel disposed adjacent to the first front panel, such that the second front panel forms the outer surface of the box, wherein the first front panel comprises a perforation extending from an edge of the second front panel and configured to allow a portion of the second front panel to be removed, thereby exposing at least a portion of the first front panel; and a first back panel opposite the first and second front panels.

In some embodiments, a method of dispensing a pourable material from a bag-in-box dispensing system is provided including: separating one or more handle perforations; separating the perforation in the second front panel to expose a portion of the first front panel; separating the substantially circular perforation in the first front panel; separating the first and second flap perforations in the first front panel; removing the fitment of the flexible container from the outer box and placing the fitment in the substantially circular perforation; rejoining the first and second flap perforations, so that the substantially circular perforation may operate to keep the fitment fixed within the outer box; and dispensing the pourable material through the fitment.

As used herein, "perforation" is used broadly to refer to a series of perforations, a single cut, or any combinations thereof.

As used herein, "about" is used broadly to refer to an amount which is within +/−10% of a given value, for example within 1% of a given value, within 2% of a given value, within 3% of a given value, within 4% of a given value, within 5% of a given value, within 6% of a given value, within 7% of a given value, within 8% of a given value, within 9% of a given value, within 10% of a given value, or any ranges therebetween.

As used herein, panels are described as disposed "adjacent" to one another if they are substantially parallel to one another and in direct contact to one another or connected by one or more additional adjacent panels. For example, a first front panel and a second front panel described herein are adjacent to one another if they are connected by third and fourth front panels disposed substantially parallel between them.

The outer box may be made from any suitable material that may be separated at the perforations. For example, the outer box may be made of corrugated cardboard, paperboard, aluminum, plastic, and the like.

The use of relational terms, such as, but not limited to, "top," "bottom," "left," "right," "upper," "lower," "down," "up," "side," and the like are used in the written description for clarity in specific reference to the Figures, or to refer to the relative disposition of panels of the box, and are not intended to further limit the scope of the invention or the appended claims. For example, "top" and "bottom" are used to refer to panels which are opposite one another, "front" and "back" are used to refer to panels which are opposite one another, and "first side" and "second side" are used to refer to panels which are opposite one another.

In some embodiments, the flexible container includes a pouring spout fitment. For example, in some embodiments, the flexible container includes a pouring spout fitment as described in U.S. Patent Publication No. 2019/0168929, International Publication No. WO 2019/108872, International Publication No. WO 2019/108870, or International Application No. PCT/US2018/055627, each of which is hereby incorporated herein by reference in its entirety. In some embodiments, the flexible container may be a flexible liner for FIBC or bag-in-box container systems, as described in U.S. Pat. No. 9,346,612.

In some embodiments, the bag-in-box dispensing system is an e-commerce ready package. That is, in some embodiments, the bag-in-box dispensing system may be shipped to an end consumer without another shipping container. In some embodiments, the bag-in-box dispensing system may be stacked on a standard shipping pallet and stacked in multiple layers. Advantageously, bag-in-box containers which are substantially in the shape of a right rectangular prism may be placed very closely together on a shipping pallet and on store shelves. As a result, more bag-in-box dispensing systems can fit within a given area than traditional rigid bottles. Further, because the bag-in-box dispensing systems include an outer box, the bag-in-box dispensing systems can advantageously be stacked on top of one another without the need for intermediate material, as would be required when stacking traditional rigid bottles or flexible containers. Moreover, bag-in-box dispensing systems which include pouring spout fitments as detailed herein may advantageously contain the pouring spout fitment sealed within the outer box, such that it cannot be intentionally or inadvertently dislodged during shipping or by end consumers before purchase.

In some embodiments, the outer box further includes at least one handle perforation in one or more of the first top panel, first side panel, second side panel, first front panel, or second front panel. For example, in some embodiments the outer box includes a series of perforations in the second front panel and a corresponding cut in the first front panel, so that the series of perforations can be separated from the second front panel to form a handle extending into an interior of the outer box. In some embodiments, the outer box includes one or more handle perforations in each of the top panel and the second side panel. In some embodiments, the outer box includes one or more handle perforations in each of the first and second side panels. In some embodiments, the outer box includes one or more handle perforations in each of the first and second top panels.

In some embodiments, the first side panel includes a top edge, a bottom edge, a front edge, and a back edge. In some embodiments, the second side panel includes a top edge, a bottom edge, a front edge, and a back edge. In some embodiments, the first bottom panel is connected to the bottom edge of the second side panel; the first front panel is connected to the front edge of the first side panel; the second front panel is connected to the front edge of the second side panel and disposed adjacent to the first front panel; and the first back panel is connected to the first side panel at the back edge of the first side panel.

In some embodiments, the outer box further includes a second back panel connected to the second side panel at the back edge of the second side panel; and a second bottom panel connected to the bottom edge of the first side panel and adjacent to the first bottom panel. In some embodiments, the outer box further includes: a third back panel connected to the top panel at the back edge of the top panel; and a fourth back panel connected to the bottom panel at the back edge of the top panel. In some embodiments, the second bottom panel is adjacent the first bottom panel, and wherein the third and fourth back panels are adjacent the first and second back panels.

In some embodiments, the first side panel includes a top edge, a bottom edge, a front edge, and a back edge; the second side panel includes a top edge, a bottom edge, a front edge, and a back edge; the first bottom panel includes a front edge and a back edge; the first top panel includes a front edge and a back edge; the first bottom panel is connected to the bottom edge of the second side panel and is connected to the bottom edge of the first side panel; the first top panel is connected to the top edge of the second side panel; the first front panel is connected to the front edge of the first bottom panel; the second front panel is connected to the front edge of the top panel and disposed adjacent to the first front panel; and the first back panel is connected to the first bottom panel at the back edge of the first bottom panel.

In some embodiments, the outer box further includes a second back panel connected to the top panel at the back edge of the first top panel; and a second top panel connected to the top edge of the first side panel and adjacent to the first top panel.

In some embodiments, the outer box further includes a third back panel connected to the first side panel at the back edge of the first side panel; and a fourth back panel connected to the second side panel at the back edge of the second side panel. In some embodiments, the second top panel is adjacent the first top panel, and wherein the third and fourth back panels are adjacent the first and second back panels.

In some embodiments, the first side panel one or more handle perforations in each of the first and second side panels a top edge, a bottom edge, a front edge, and a back edge; the second side panel one or more handle perforations in each of the first and second side panels a top edge, a bottom edge, a front edge, and a back edge; the first bottom panel one or more handle perforations in each of the first and second side panels a front edge and a back edge; the first top panel one or more handle perforations in each of the first and second side panels a front edge and a back edge; the first bottom panel is connected to the bottom edge of the second side panel and is connected to the bottom edge of the first side panel; the first top panel is connected to the top edge of the first side panel; the first front panel is connected to the front edge of the first bottom panel; the second front panel is connected to the front edge of the top panel and disposed adjacent to the first front panel; and the first back panel is connected to the first bottom panel at the back edge of the first bottom panel.

In some embodiments, the outer box further includes a second back panel connected to the top panel at the back edge of the first top panel; and a third side panel connected to the second side edge of the first top panel and adjacent to the second side panel. In some embodiments, the outer box further one or more handle perforations in each of the first and second side panels a third back panel connected to the first side panel at the back edge of the first side panel; and a fourth back panel connected to the second side panel at the back edge of the second side panel. In some embodiments, the third and fourth back panels are adjacent the first and second back panels.

In some embodiments, the first side panel includes a top edge, a bottom edge, a front edge, and a back edge; the second side panel includes a top edge, a bottom edge, a front edge, and a back edge; the first bottom panel includes a front edge and a back edge; the first top panel includes a front edge and a back edge; the first bottom panel is connected to the bottom edge of the second side panel and is connected to the bottom edge of the first side panel; the first top panel is connected to the top edge of the first side panel; the first front panel is connected to the front edge of the first bottom panel; the second front panel is connected to the front edge of the first top panel and disposed adjacent to the first front panel; and the first back panel is connected to the first bottom panel at the back edge of the first bottom panel.

In some embodiments, the outer box includes a second back panel connected to the top panel at the back edge of the first top panel; and a second top panel connected to the top edge of the second side panel and adjacent to the first top panel.

In some embodiments, the outer box includes a third back panel connected to the first side panel at the back edge of the first side panel; and a fourth back panel connected to the second side panel at the back edge of the second side panel.

In some embodiments, the third and fourth back panels are adjacent the first and second back panels.

In some embodiments, the outer box includes a third front panel connected to the first side panel at the front edge of the first side panel; and a fourth front panel connected to the second side panel at the front edge of the second side panel. In some embodiments, the third and fourth front panels are adjacent the first and second front panels.

In some embodiments, the inner flexible container contains a pourable material, for example a liquid of a pourable powder. In some embodiments, the inner flexible container includes a pouring spout fitment attached to the flexible container. For example, in some embodiments the pouring spout fitment includes: (1) a hollow rigid member comprising a top end having a discharge opening and a base end having a base end opening, an inner surface defining an inner space extending between the discharge opening and the base end opening, and an outer surface, (2) an extendible spout at least partially disposed in the hollow rigid member and connected to the hollow rigid member, the extendible spout comprising: a proximal end and a proximal opening, the proximal end connected to the base end of the hollow rigid member, a distal end and a distal opening, the distal end configured to extend from and retract at least partially into the hollow rigid member, a discharge passage that extends from the proximal opening to the distal opening, and a duck bill valve disposed in the discharge passage, wherein the extendible spout is configured to dispense the pourable material from the container through the distal opening when the hollow rigid member is attached to the friction fit opening, and wherein the perforation is configured to allow a user to remove at least a portion of the pouring spout fitment so that it extends beyond the front panel. In some embodiments, the substantially circular perforation is configured to secure a portion of the hollow rigid member of the pouring spout fitment.

In some embodiments, the outer box may be assembled so that the panels forming the interior surface of the box are as large as possible, to minimize the number of sharp edges which may come into contact with the inner flexible package. For example, each of the first and second front panels may be about the same size, such that the edges of the first front panel are substantially in contact with the interior of the first top panel, first side panel, second side panel, and first bottom panel. Similarly, the third and fourth front panels may be attached to the exterior surface of the first front panel or the exterior surface of the second front panel, so that none of the edges of the third and fourth front panels may come into contact with the inner flexible package.

In some embodiments, the various panels of the outer box may be joined without blocking any of the aforementioned perforations with an adhesive material. For example, in some embodiments the third and fourth front panels are smaller than the first or second front panels and do not obstruct access to the perforation in the second front panel.

In some embodiments, a one gallon bag-in-box dispensing system is provided which has been optimized for shipping on a standard 48 inch by 48 inch shipping pallet. Specifically, in this embodiment the first and second side panels may measure about 10⅝ inches by 7¼ inches, the top panel may measure about 10⅝ inches by about 4¾ inches, the bottom panel may measure about 4⅝ inches by about 10⅝ inches, and the first and second front panel and the first and second back panel may measure about 7¼ inches by about 4½ inches. In some embodiments, the first front panel may be slightly smaller than the second front panel so that it will more easily fold to form an interior surface of the outer box. Similarly, in some embodiments the first back panel may be slightly smaller than the second back panel so that it may more easily fold to form an interior surface of the outer box. Advantageously, a one gallon bag-in-box dispensing system according to this embodiment can accommodate 240 boxes per pallet, compared to only 144 of a comparable 1 gallon rigid package. That is, using a one gallon bag-in-box dispensing system as described herein increases the capacity of a single pallet by 40%, resulting in 40% less warehouse space needed to store the same volume of pourable material.

In some embodiments, a two and a half gallon bag-in-box dispensing system is provided which has been optimized for shipping on a standard 48 inch by 48 inch shipping pallet. Specifically, in this embodiment the bottom panel and the second side panel each measure about 7¾ inches by 12 9/16 inches, the first side panel is about 7 13/16 inches by 12 13/16 inches, and the second side panel is about 7 9/16 inches by 12 3/16 inches. Each of the first front panel, second front panel, first back panel, and second back panel are about 7½ inches by about 7½ inches. In some embodiments, the first front panel may be slightly smaller than the second front panel so that it will more easily fold to form an interior surface of the outer box. Similarly, in some embodiments the first back panel may be slightly smaller than the second back panel so that it may more easily fold to form an interior surface of the outer box. Advantageously, a two and a half gallon bag-in-box dispensing system according to this embodiment can accommodate 120 boxes per pallet, compared to only 80 of a comparable 2.5 gallon rigid package.

In some embodiments, a five gallon bag-in-box dispensing system is provided which has been optimized for shipping on a standard 48 inch by 48 inch shipping pallet. Specifically, in this embodiment the bottom panel measures about 12¾ inches by 9 13/16 inches, the first top panel measures about 13⅜ inches by about 9⅞ inches, the first side panel measures about 11⅛ inches by 13⅜ inches, and the second side panel measures about 10 15/16 inches by 12¾ inches. The first front panel and second front panel each measure about 10⅞ inches by 9 13/16 inches and each of the second front panel and second back panel measure about 10⅞ inches by 10⅞ inches. Advantageously, a five gallon bag-in-box dispensing system according to this embodiment can accommodate 30 boxes per pallet, compared to only 20 of a comparable 5 gallon rigid package.

Illustrated Embodiments

Embodiments of the present disclosure are illustrated in the figures, which are described in more detail below.

Bag-in-Box Dispensing System and Method

FIGS. 1-12 illustrate an embodiment of a bag-in-box dispensing system 1100 in various views. This dispensing system 1100 includes an outer box 1101 and an inner flexible container 1103. The outer box 1101 includes a bottom panel 1105, a first top panel 1107, a first side panel 1125 and a second side panel 1127. The top panel 1107 has a handle perforation 1109, a front edge 1111, a back edge 1113, and a first side edge 1115. The bottom panel 1105 has a front edge 1117, a back edge 1119, a first side edge 1121, and a second side edge 1123.

Figure 7:
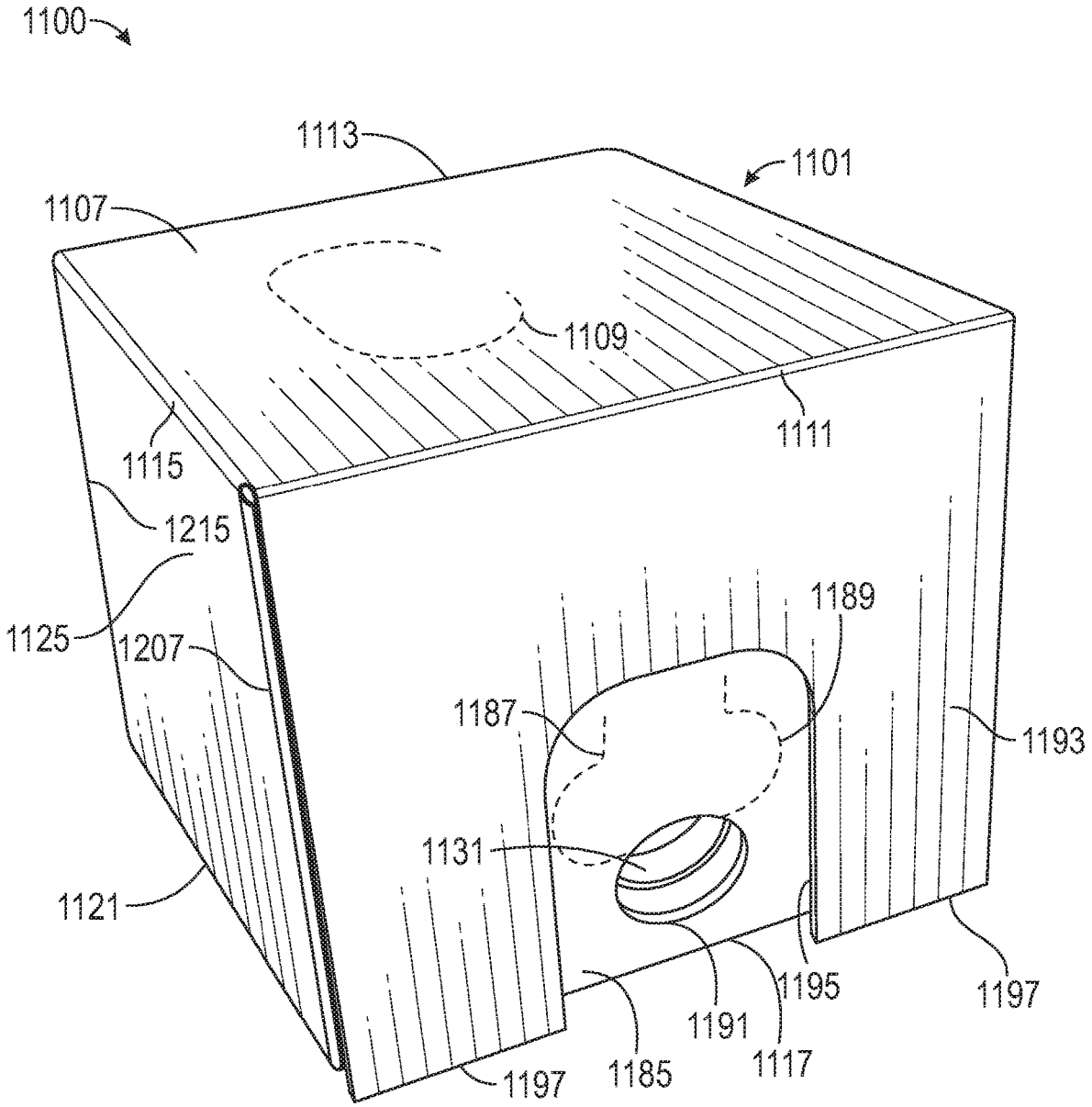
FIG. 7 is a perspective-view of the bag-in-box dispensing system of FIG. 6 with a completely separated substantially circular perforation.
Figure 8:
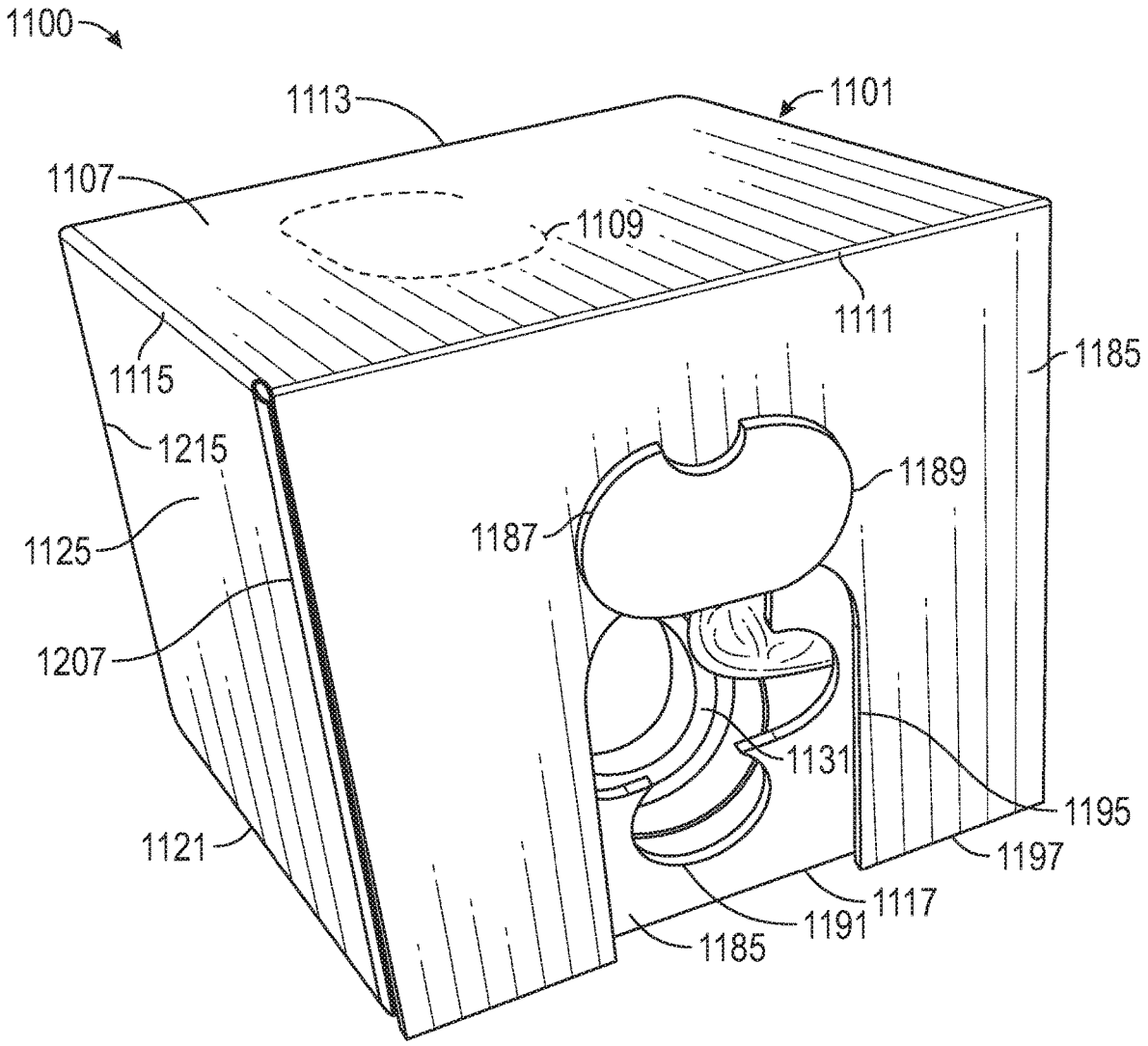
FIG. 8 is a perspective view of the bag-in-box dispensing system of FIG. 7 with a separated first and second flap perforations.
Figure 9:
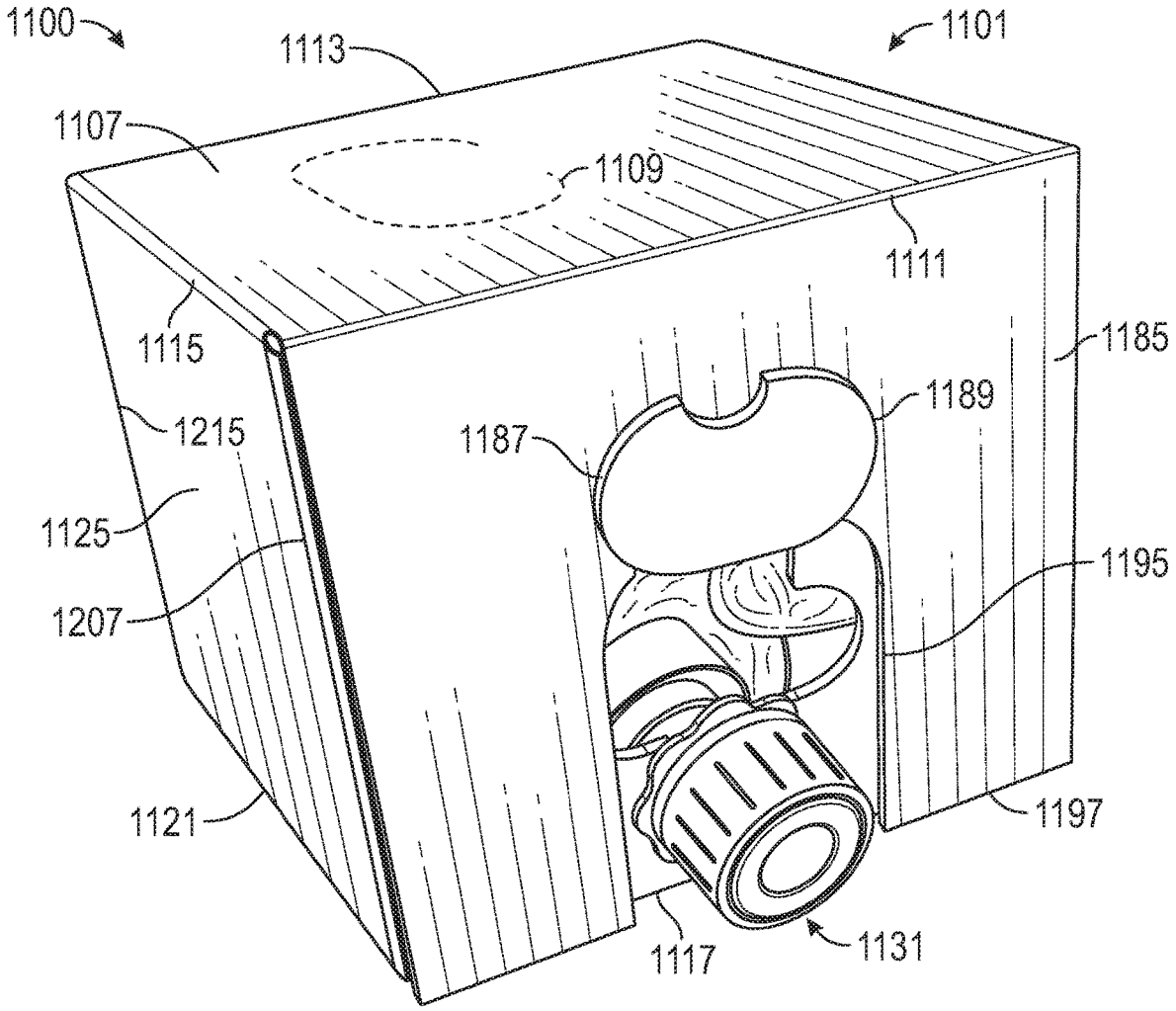
FIG. 9 is a perspective view of the bag-in-box dispensing system of FIG. 8 with a portion of the pouring spout fitment extending from the first front panel and the second front panel.

The outer box 1101 further includes a second top panel 1129 including a handle perforation 1109 and a second side edge 1183. The outer box 1101 further includes a first front panel 1185 including a first flap perforation 1187 and a second flap perforation 1189 that, when separated together, may form a removable flap to allow for the passage of a dispensing system, as is shown in FIGS. 8 and 9. The first and second flap perforations 1187, 1189 are each connected to a substantially circular perforation 1191 which is configured to be separated such that the portion of the first front panel 1185 which is surrounded by the substantially circular perforation 1191 can be completely removed from the first front panel 1185, as is shown in FIG. 7. In this way, the substantially circular perforation may receive a pouring spout fitment 131 of the inner flexible container 1103, as is shown in FIG. 10.

Figure 5:
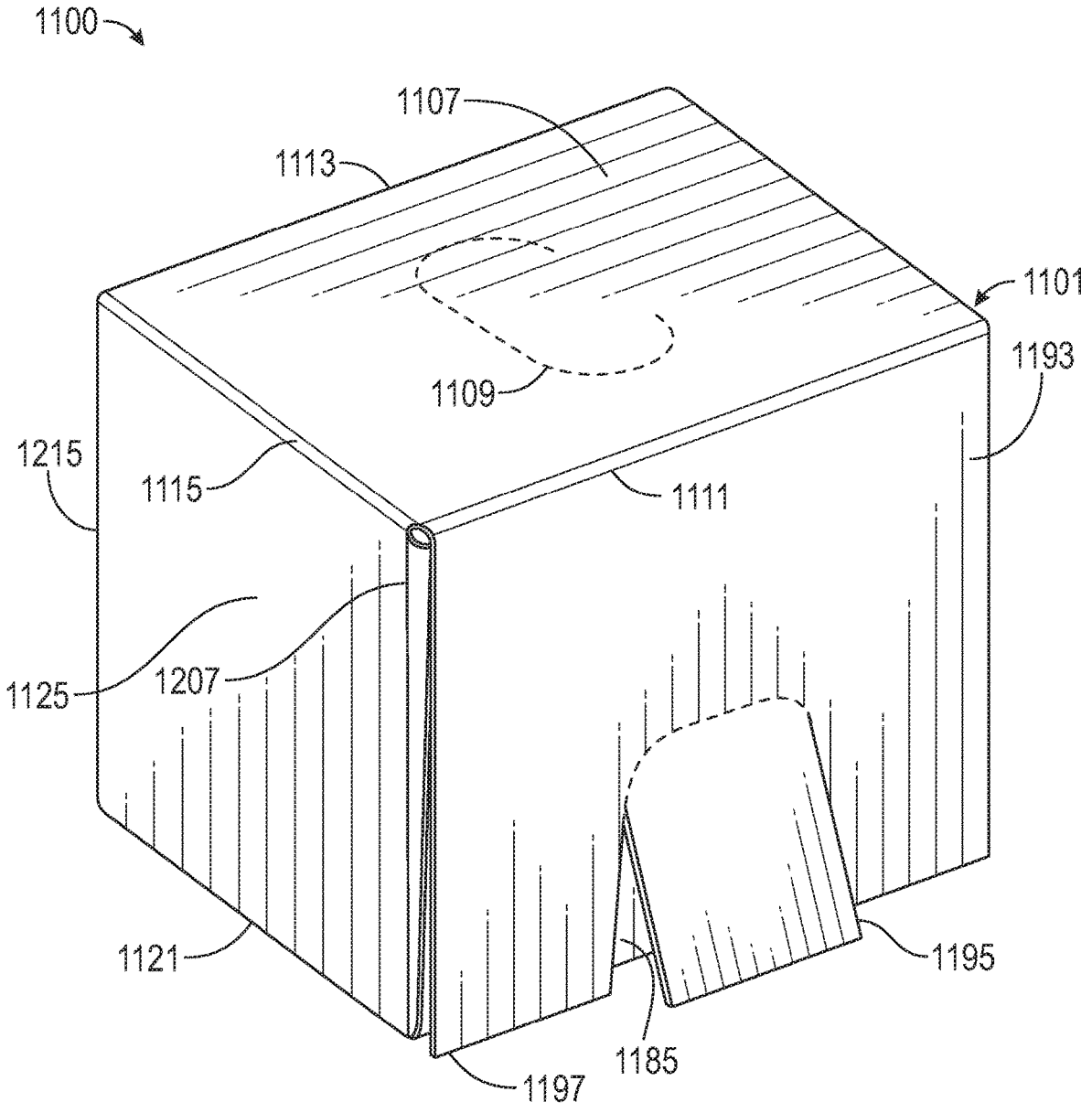
FIG. 5 is a perspective view of the bag-in-box dispensing system of FIG. 1 with the first and second front panels closed and the perforation in the second front panel partially separated.
Figure 6:
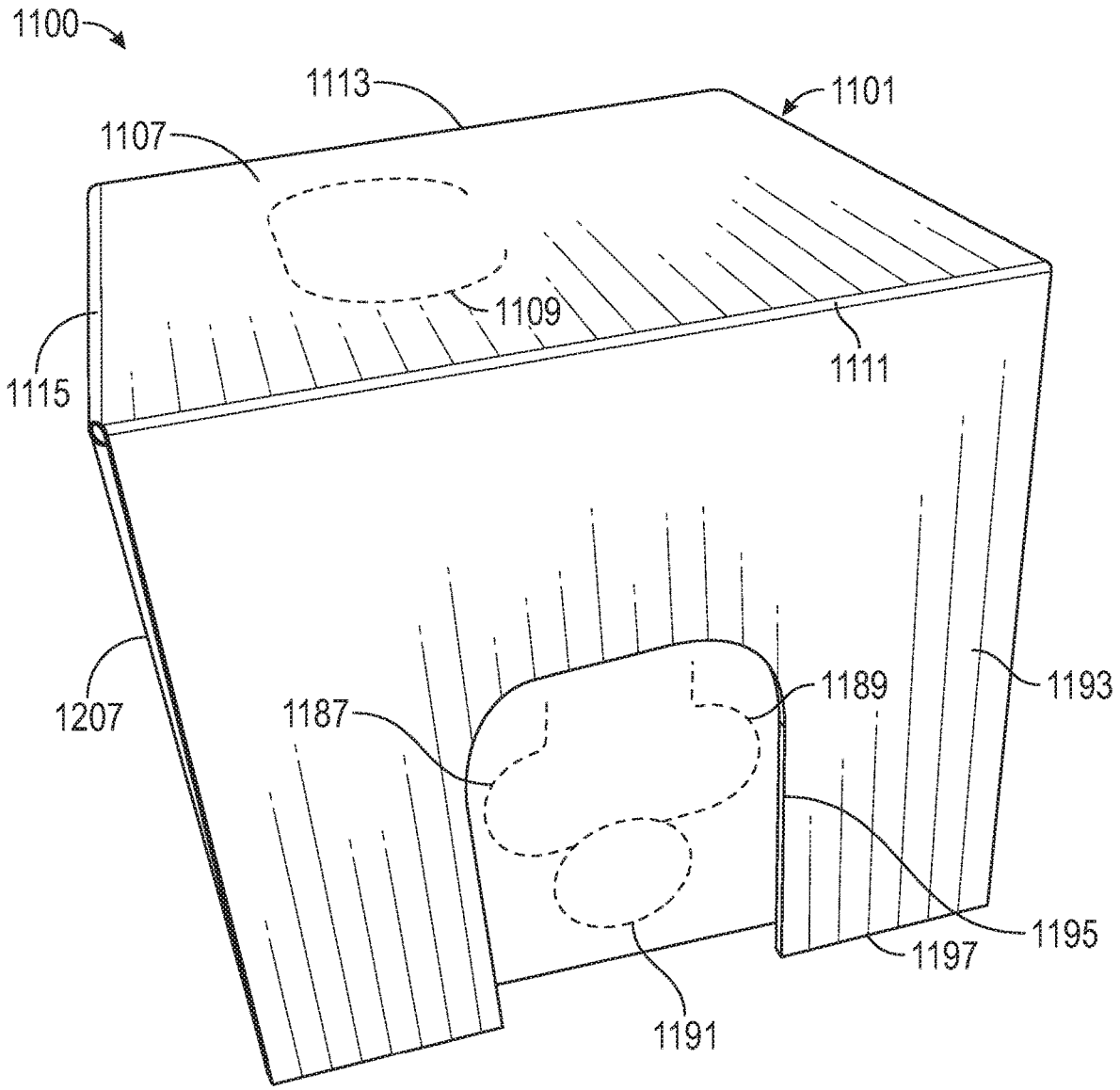
FIG. 6 is a perspective view of the bag-in-box dispensing system of FIG. 1 with closed first and second front panels and the perforation in the second front panel completely separated.
Figure 10:
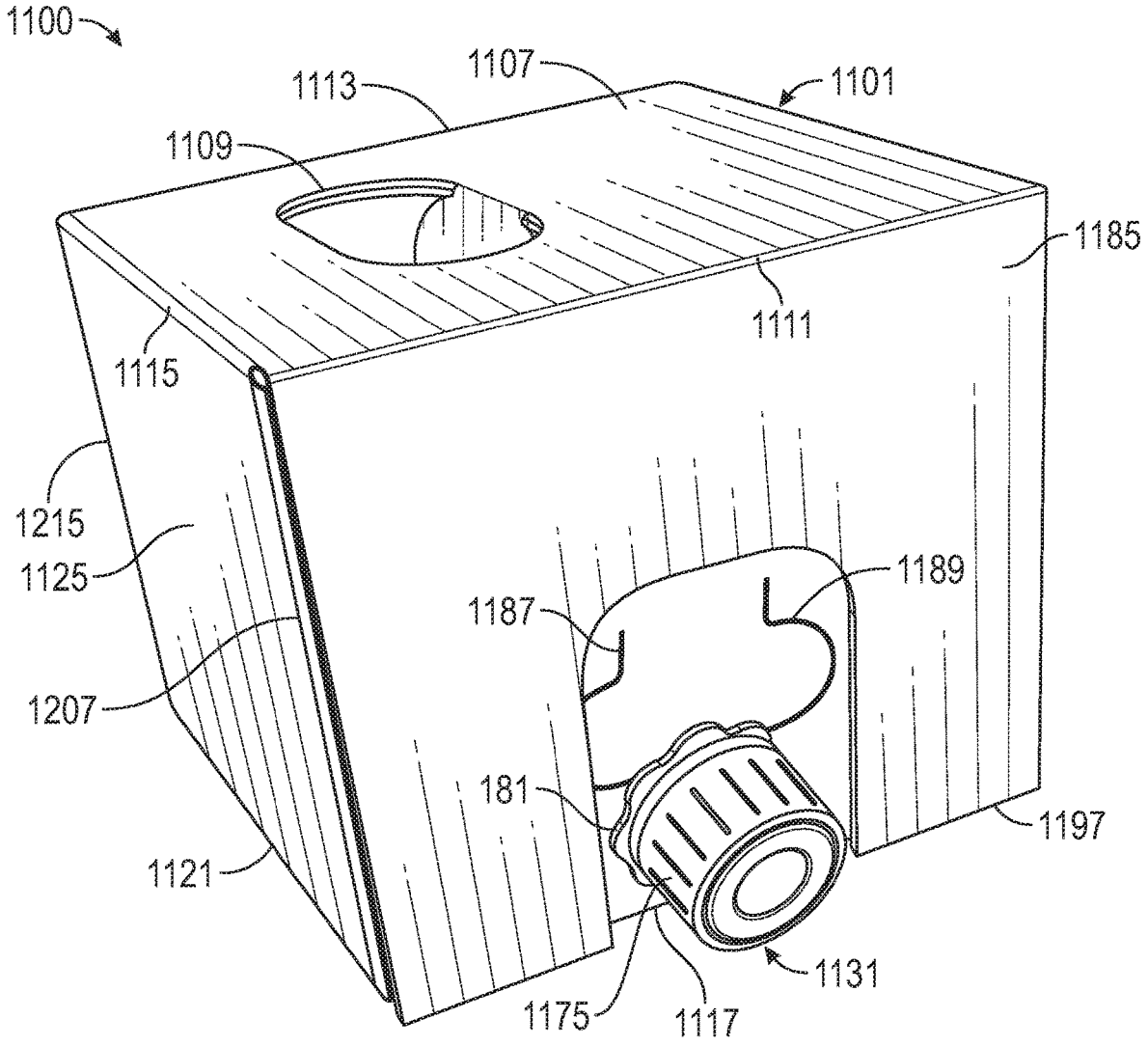
FIG. 10 is a perspective view of the bag-in-box dispensing system of FIG. 9 with the first flap perforation and second flap perforation rejoined.
Figure 11:
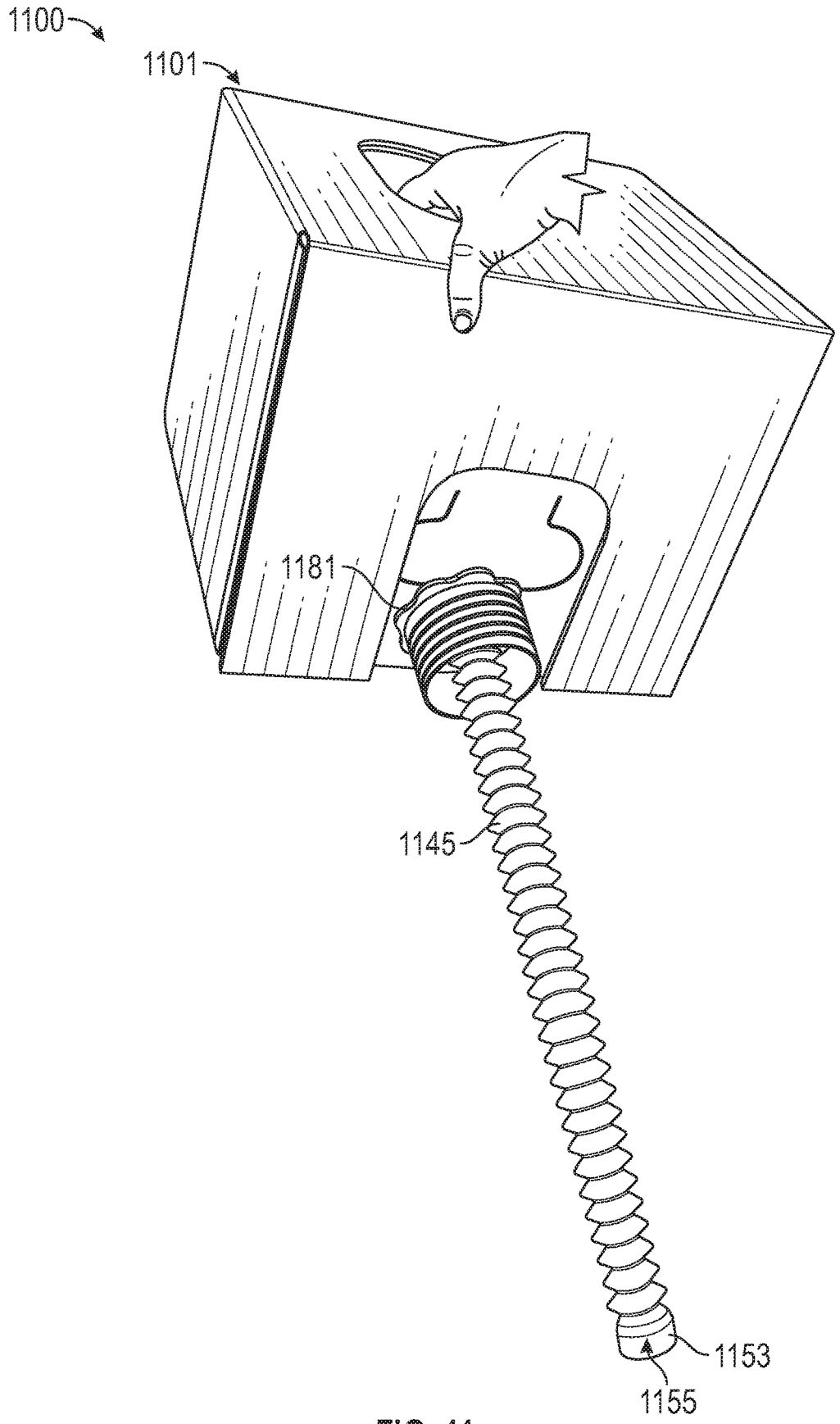
FIG. 11 is a perspective view of the bag-in-box dispensing system of FIG. in use with the removable lid removed and the distal end of the extendible spout extended.
Figure 12:
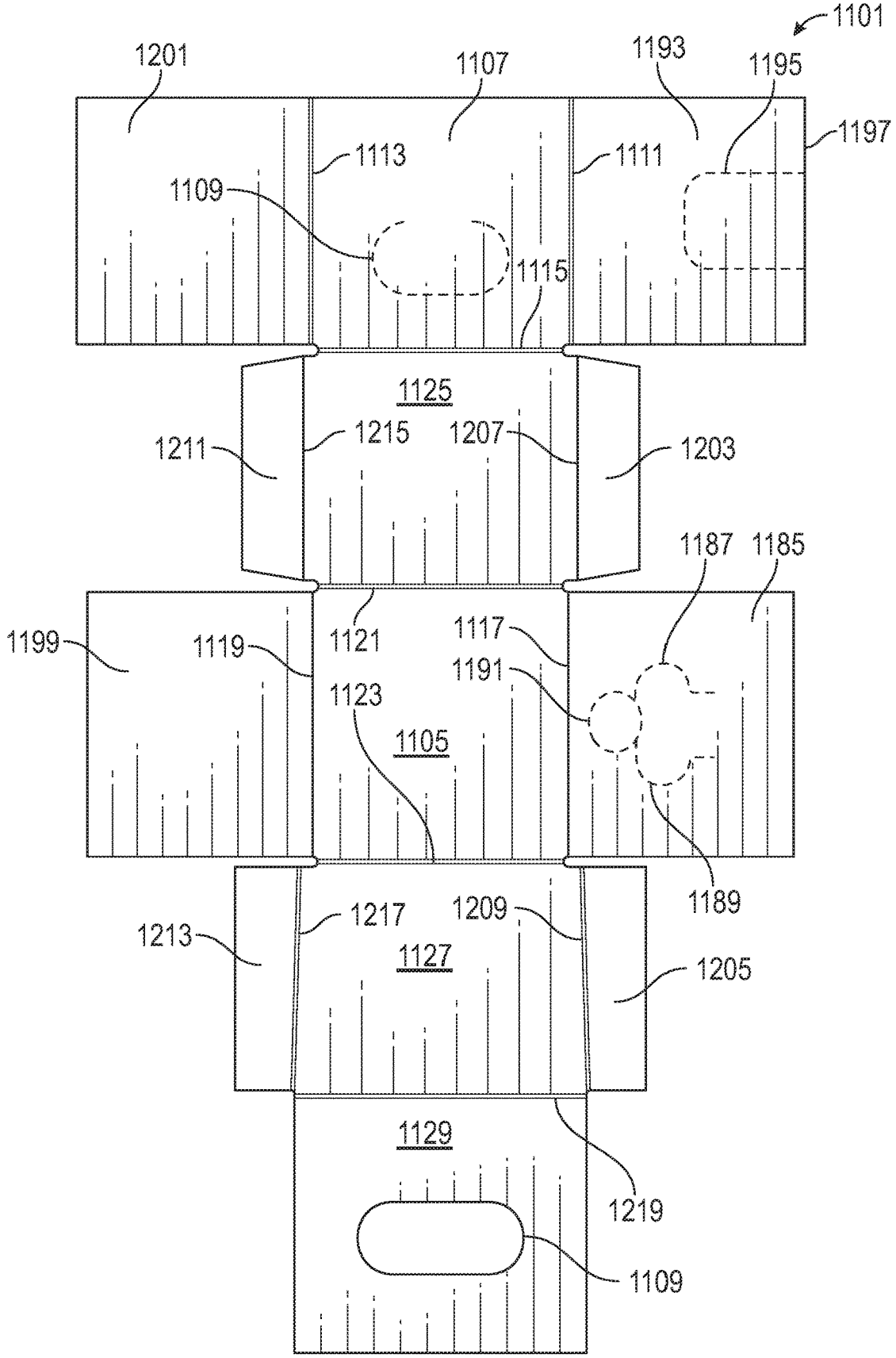
FIG. 12 is disassembled outer box of the bag-in-box dispensing system of FIG. 1.

Thus, to dispense a pourable material using the bag-in-box dispensing system of FIGS. 1-12, the perforation 1195 in the second front panel 1193 may first be separated as illustrated in FIG. 5. When completely separated, this will expose the first front panel 1185, including the substantially circular perforation 1191 and the first and second flap perforations 1187, 1189, as shown in FIG. 6. Next, the substantially circular perforation may be separated, such as by pushing towards the inner flexible container to expose a portion of the pouring spout fitment 131, as illustrated in FIG. 7. The first and second flap perforations 1187, 1189 may then be separated to further expose the pouring spout fitment 131 as illustrated in FIG. 8, and the pouring spout fitment may be placed in the substantially circular perforation as illustrated in FIG. 9. Next, the first and second flap perforations 1187, 1189 may be rejoined as illustrated in FIG. 10, to retain the pouring spout fitment 131 in the outer box. The pouring spout fitment can then be used to dispense a pourable material, as illustrated in FIG. 11.

Inner Flexible Containers

FIGS. 13-17 depict an exemplary embodiment of a pouring spout fitment for use with a flexible package in various configurations.

Figure 13:
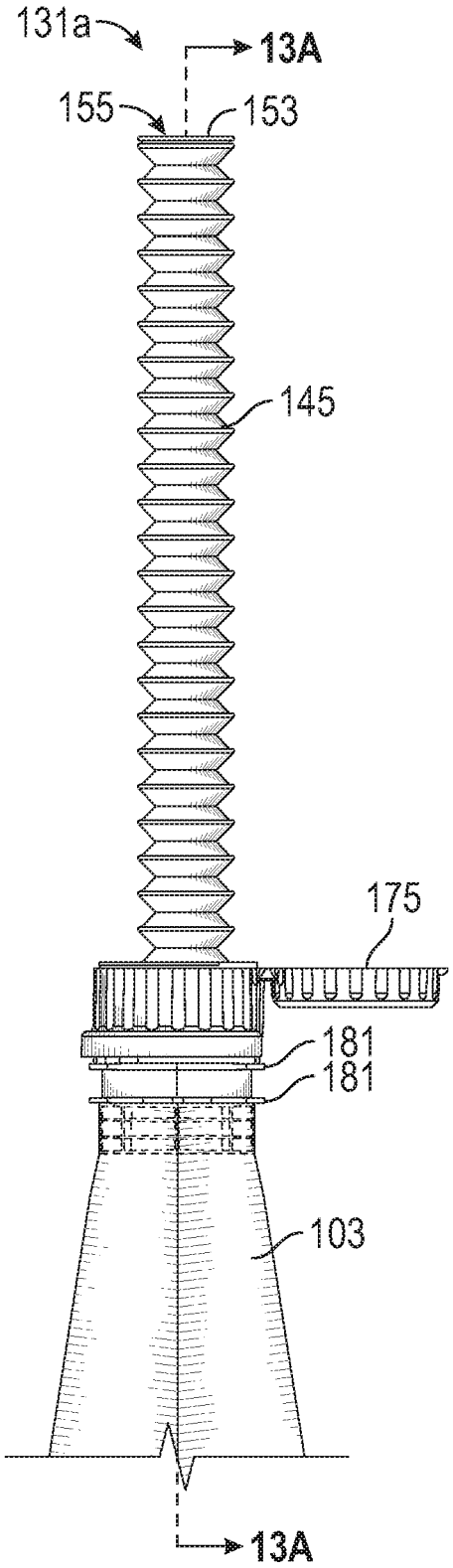
FIG. 13 is a perspective view of an embodiment of a pouring spout fitment disposed in a flexible container which may be used in embodiments of the bag-in-box dispensing systems disclosed herein.
Figure 13A:
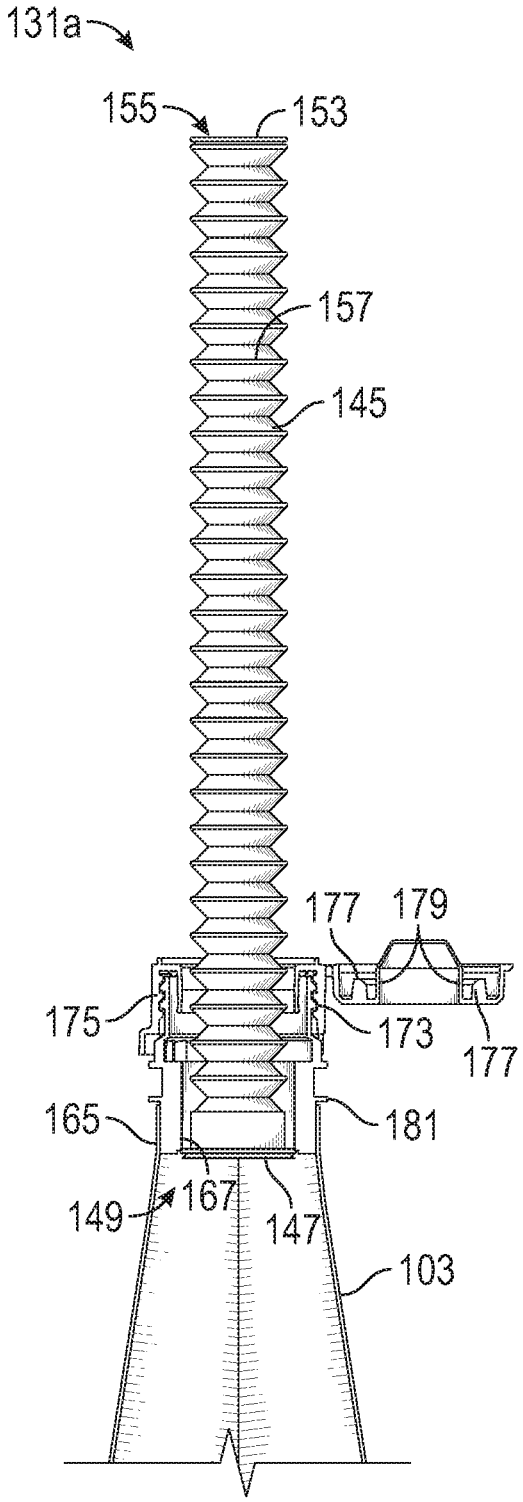
FIG. 13A is a is a cross-section of the pouring spout fitment and flexible container of FIG. 13, taken along line A-A.
Figure 14:
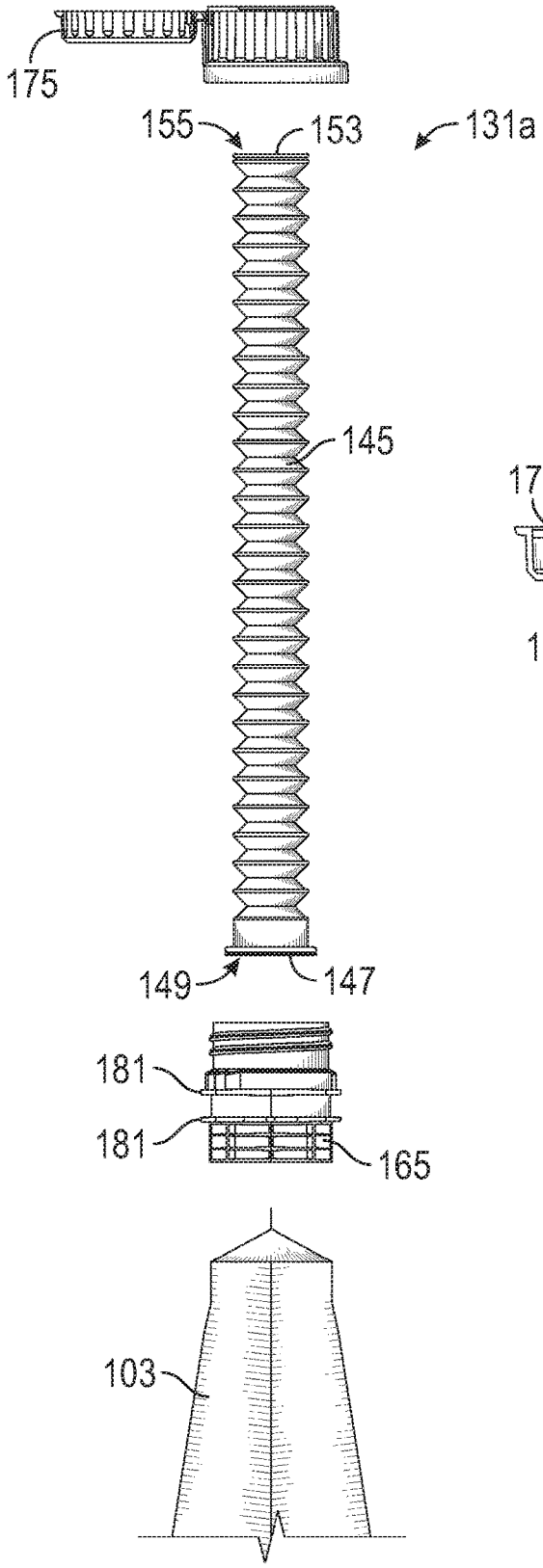
FIG. 14 is an exploded view of the pouring spout fitment and flexible container of FIG. 13
Figure 15:
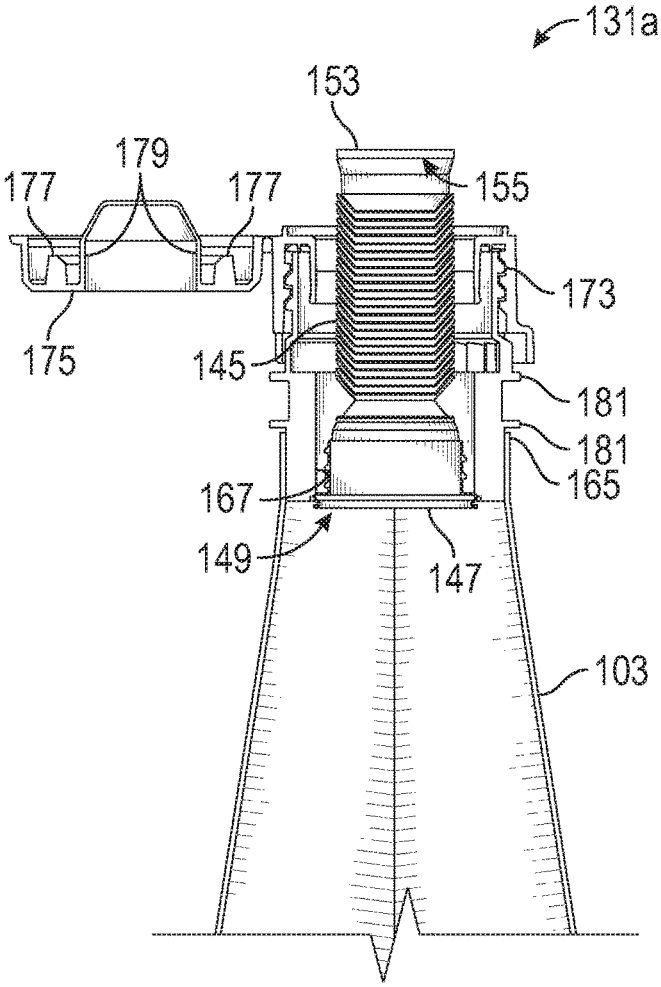
FIG. 15 is a cross-section of the pouring spout fitment and flexible container of FIG. 13 as shown in FIG. 13A, where the extendible spout is shown in a retracted position.

FIGS. 13 and 13A illustrate pouring spout fitment 131*a* for a flexible container 103, which includes a hollow canoe portion 165 having a body with an inner surface 167 defining a passage extending through the body, wherein the outer surface is configured to be attached directly to the inner surface of a flexible container 103. FIG. 14 is an exploded view of the pouring spout fitment 131*a* and flexible container 103 of FIG. 13. For example, the hollow canoe portion 165 may be welded to the inner surface of a flexible container. The pouring spout fitment further includes an extendible spout 145 that is at least partially disposed in and connected to the hollow canoe portion 165. The extendible spout 145 includes a proximal end 147 and a proximal opening 149, a distal end 153 and a distal opening 155, and a discharge passage 157. The proximal end 147 is connected to the hollow canoe portion 165, the distal end 153 is configured to extend from and retract at least partially into the hollow canoe portion 165, and the discharge passage 157 extends from the proximal opening 149 to the distal opening 155. The extendible spout is configured to extend between an extended position, wherein the distal end 153 extends from top end of the hollow canoe portion 165, and a retracted position, wherein the distal end 153 retracts at least partially into the hollow canoe portion 165. The extendible spout 145 is configured to dispense the pourable material from the flexible package 103 through the distal opening 155 when the hollow canoe portion 165 is attached to the inner surface of the flexible package 103. FIGS. 13 and 13A illustrate the extendible spout in an extended configuration. The pouring spout fitment 131*a* further includes a removable lid 175, which is attached to the top end of the hollow canoe portion 165 by threads 173.

The removable lid 175 can be hingedly moved between an open position and a closed position, wherein the removable lid covers the distal end 153 of the extendable spout 145. The removable lid 175 further includes a first sealing flange 177 and a second sealing flange 179 both extending inwardly of the inner surface of the removable lid 175. The first sealing flange 177 is configured to engage with the top end of the hollow canoe portion 165 when the removable lid 175 is in a closed position. The second sealing flange 179 is configured to engage with the distal end 153 of the extendible spout 145 when the removable lid 175 is in a closed position. The second sealing flange 179 is disposed inwardly of the first sealing flange 177 The pouring spout fitment further includes a rail grabber portion consisting of two planar protrusions 181. These protrusions are configured to allow the fitment 131*a* and a flexible package 103 attached to the fitment 131*a* to be easily transported along typical manufacturing equipment according to methods known in the art.

Figure 16:
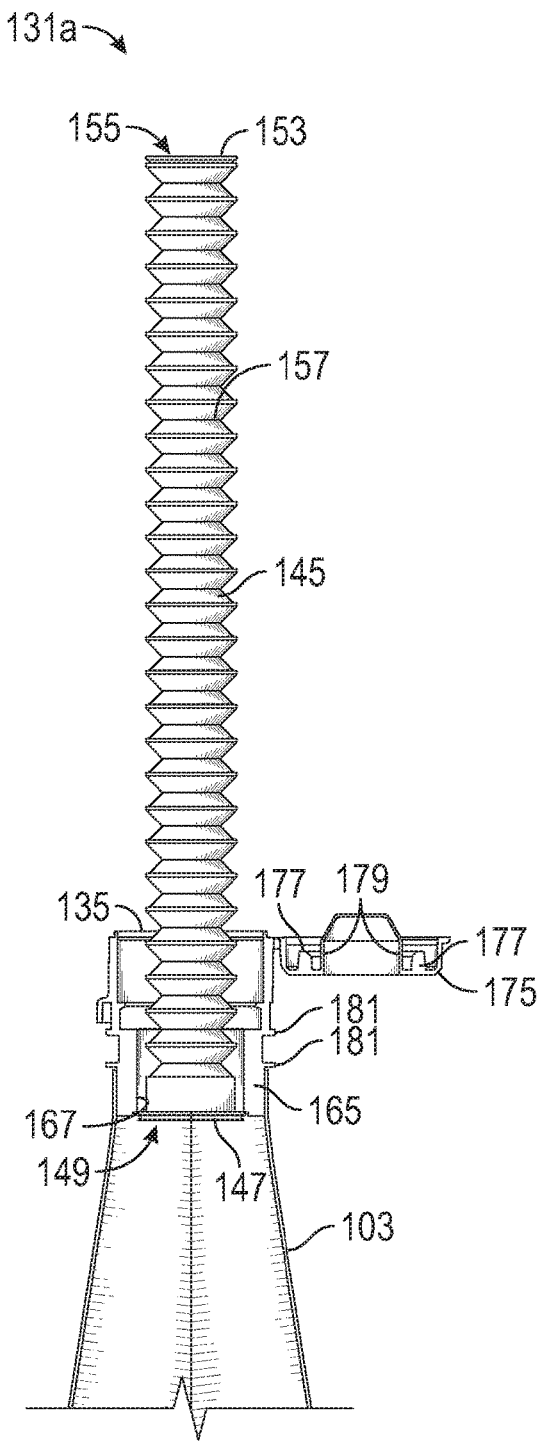
FIG. 16 is a cross-sectional view of a one-piece embodiment of the pouring spout fitment of FIG. 13.

FIG. 16 illustrates an alternate embodiment of the pouring spout fitment 131*a*. This embodiment includes a hollow canoe portion 165, a rail grabber portion 181, and an extendible spout 145 as described above. However, in this embodiment the lid 175 is integral with the remainder of the fitment 131*a*. In this embodiment, the lid 175 may be formed in a single injection molding step, and is hingedly connected to the hollow canoe portion 165 and rail grabber portion 181.

FIGS. 17-20 depict an exemplary embodiment of a pouring spout fitment with friction fit attachment means for use with a flexible package in various configurations.

Figure 17:
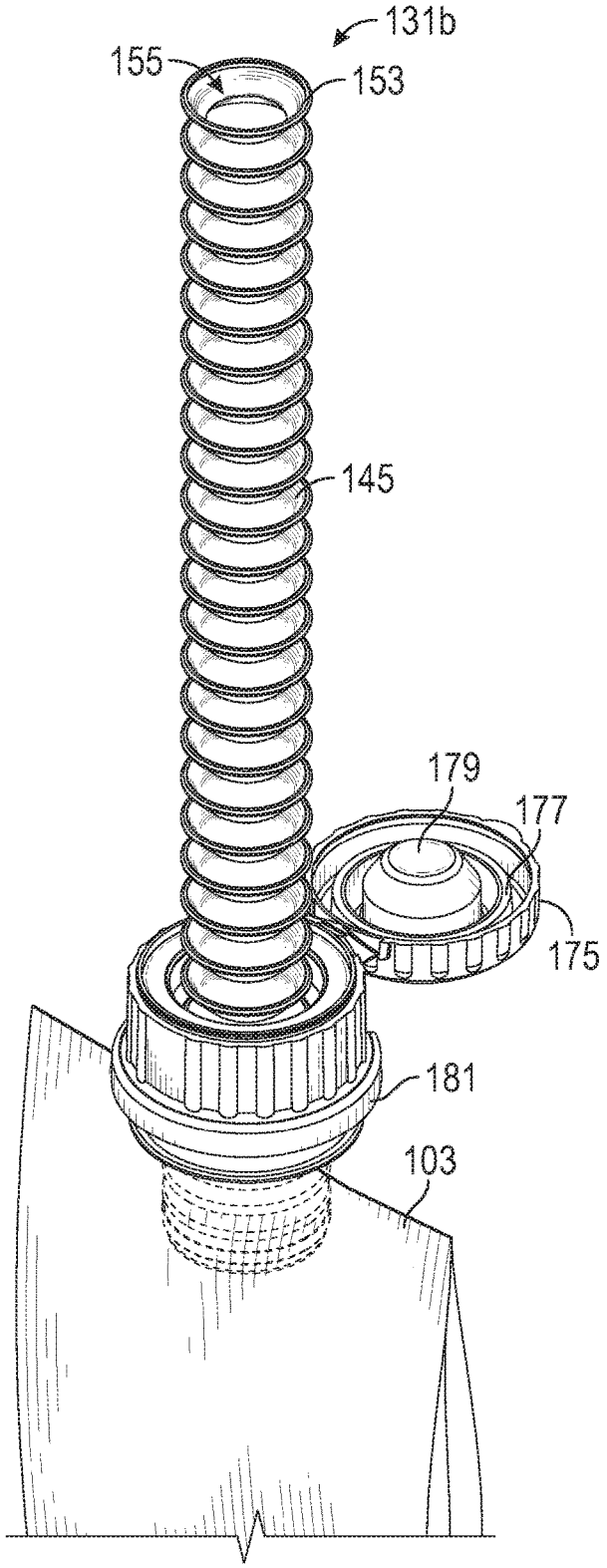
FIG. 17 is a perspective view of an embodiment of a friction pouring spout fitment disposed in a flexible container.
Figure 17A:
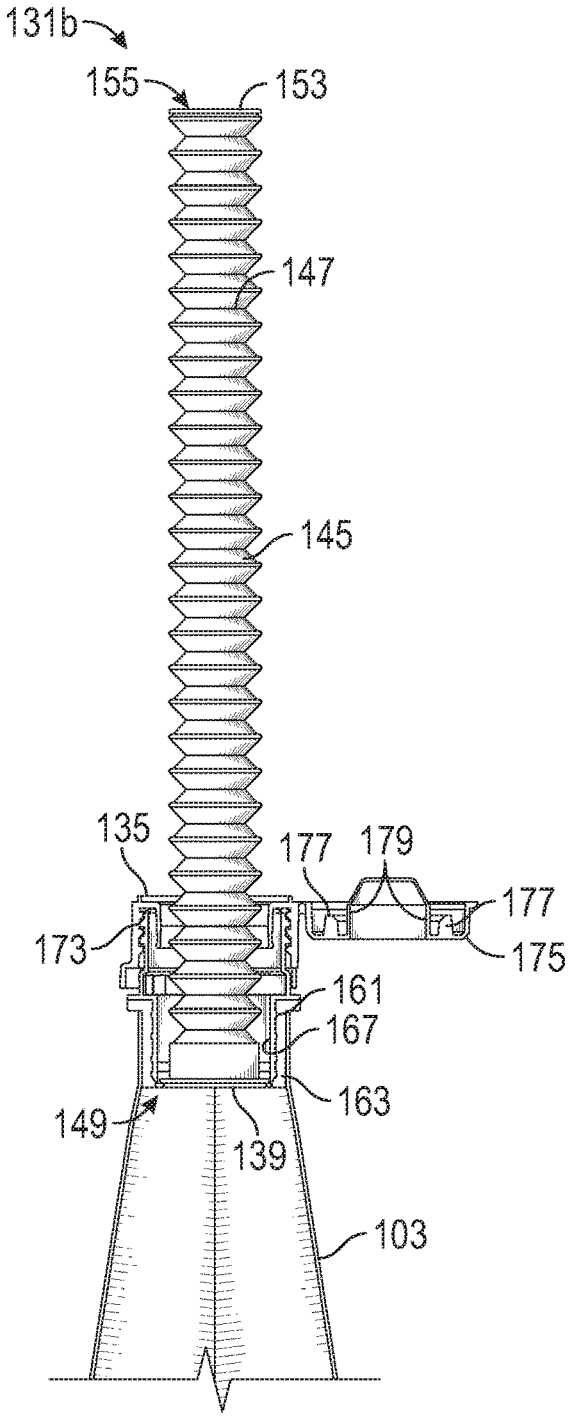
FIG. 17A is a cross-section of the pouring spout fitment and flexible container of FIG. 17, taken along line A-A.
Figure 18:
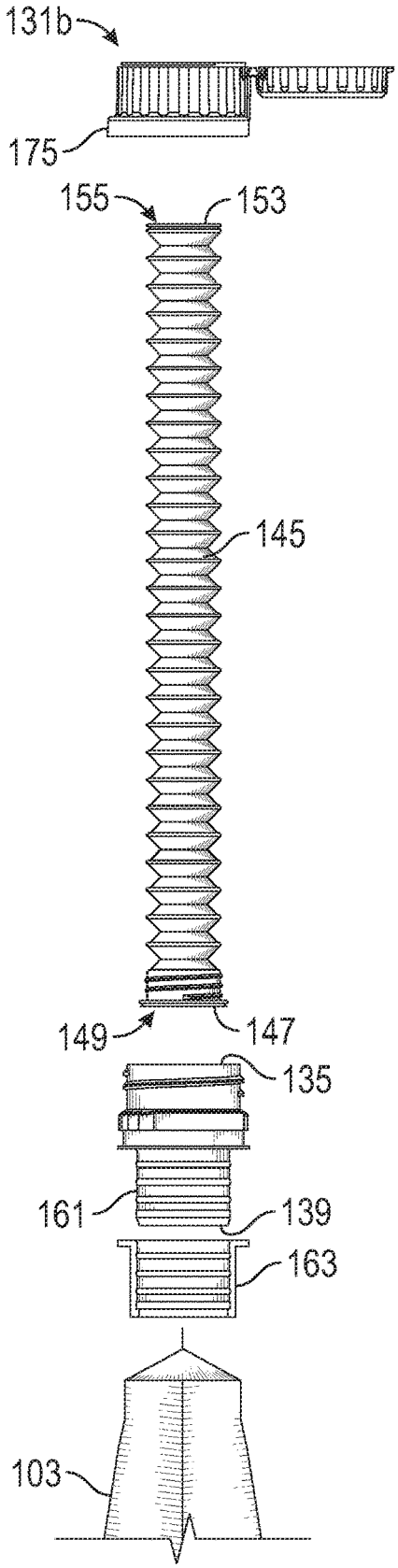
FIG. 18 is an exploded view of the pouring spout fitment and flexible container of FIG. 17.

FIGS. 17 and 17A illustrate pouring spout fitment 131*b* for a flexible container 103. FIG. 17A depicts a cross-sectional view of the pouring spout fitment 131*b* of FIG. 17, taken along line A-A. The pouring spout fitment 131*b* includes an extendible spout 145 that is at least partially disposed in and connected to a hollow rigid member 161. The extendible spout 145 includes a proximal end 147 and a proximal opening 149, a distal end 153 and a distal opening 155, and a discharge passage 147. The proximal end 147 is connected to the hollow rigid member 161, the distal end 153 is configured to extend from and retract at least partially into the hollow rigid member 161, and the discharge passage 147 extends from the proximal opening 149 to the distal opening 155. The extendible spout is configured to extend between an extended position, wherein the distal end 153 extends from top end of the hollow rigid member 161, and a retracted position, wherein the distal end 153 retracts at least partially into the hollow rigid member 161. The extendible spout 145 is configured to dispense the pourable material from the flexible package 103 through the distal opening 155 when the hollow canoe portion 161 is attached to the inner surface of the flexible package 103 by means of a friction fitment 163. FIGS. 17, 17A, and 18 illustrate the extendible spout in an extended configuration.

The pouring spout fitment 131*b* further includes a rail grabber portion having a single protrusion 181 configured to allow the fitment 131*b* and a flexible package 103 attached to the fitment 131*b* to be easily transported along typical manufacturing equipment according to methods known in the art. The pouring spout fitment 131*b* further includes a removable lid 175, which is attached to the top end of the hollow rigid member 161 by threads 173.

The removable lid 175 can be hingedly moved between an open position and a closed position, wherein the removable lid covers the distal end 153 of the extendable spout 145. The removable lid 175 further includes a first sealing flange 177 and a second sealing flange 179. The first sealing flange 177 is configured to engage with the top end of the hollow rigid member 161 when the removable lid 175 is in a closed position. The second sealing flange 179 is configured to engage with the distal end 153 of the extendible spout 145 when the removable lid 175 is in a closed position. Both the first sealing flange 177 and the second sealing flange 179 extend inwardly from the inner surface of the removable lid 175. The second sealing flange 179 is disposed inwardly of the first sealing flange 177.

Figure 19:
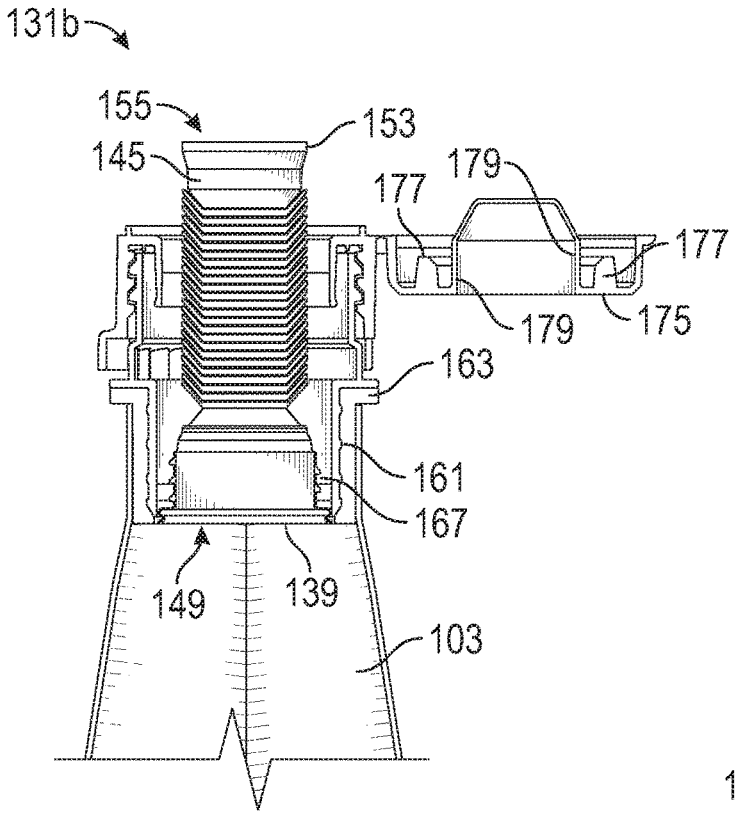
FIG. 19 is a cross-section of the pouring spout fitment and flexible container of FIG. 17 as shown in FIG. 17A, where the extendible spout is shown in a retracted position.

FIG. 19 illustrates a cross-section of the pouring spout fitment 131*b* and flexible package 103 of FIG. 17 as shown in FIG. 17A, where the extendible spout is shown in a retracted position.

Figure 20:
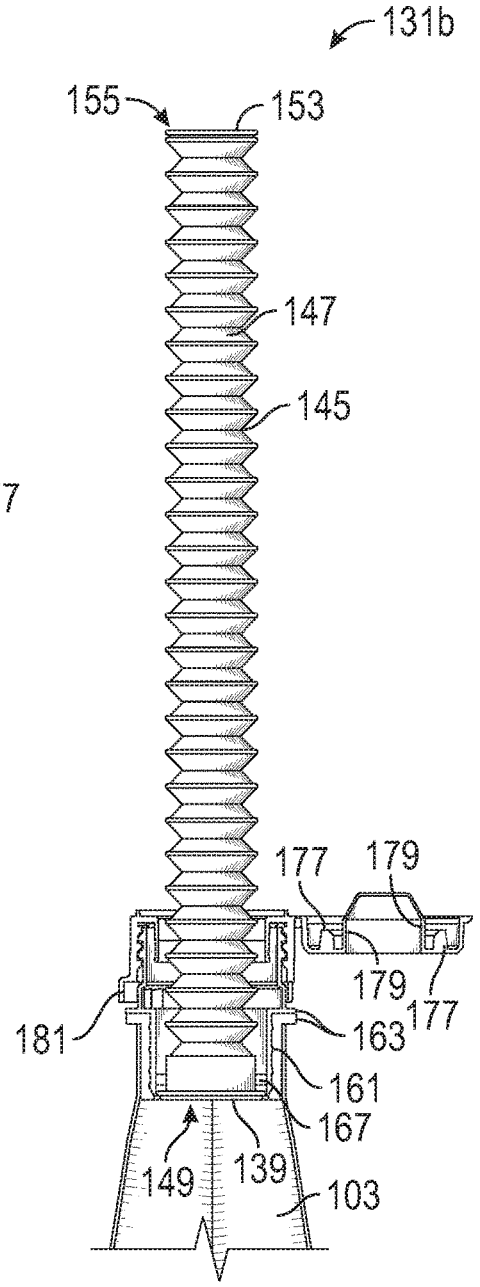
FIG. 20 is a cross-sectional view of a one-piece embodiment of the pouring spout fitment of FIG. 17.

FIG. 20 illustrates an alternate embodiment of the pouring spout fitment 131*b*. This embodiment includes a hollow rigid member 161, a rail grabber portion 181, and an extendible spout 145 as described above. However, in this embodiment the lid 175 is integral with the remainder of the fitment 131*b*. In this embodiment, the lid 175 may be formed in a single injection molding step, and is hingedly connected to the hollow rigid member 161 and rail grabber portion 181.

Figure 21:
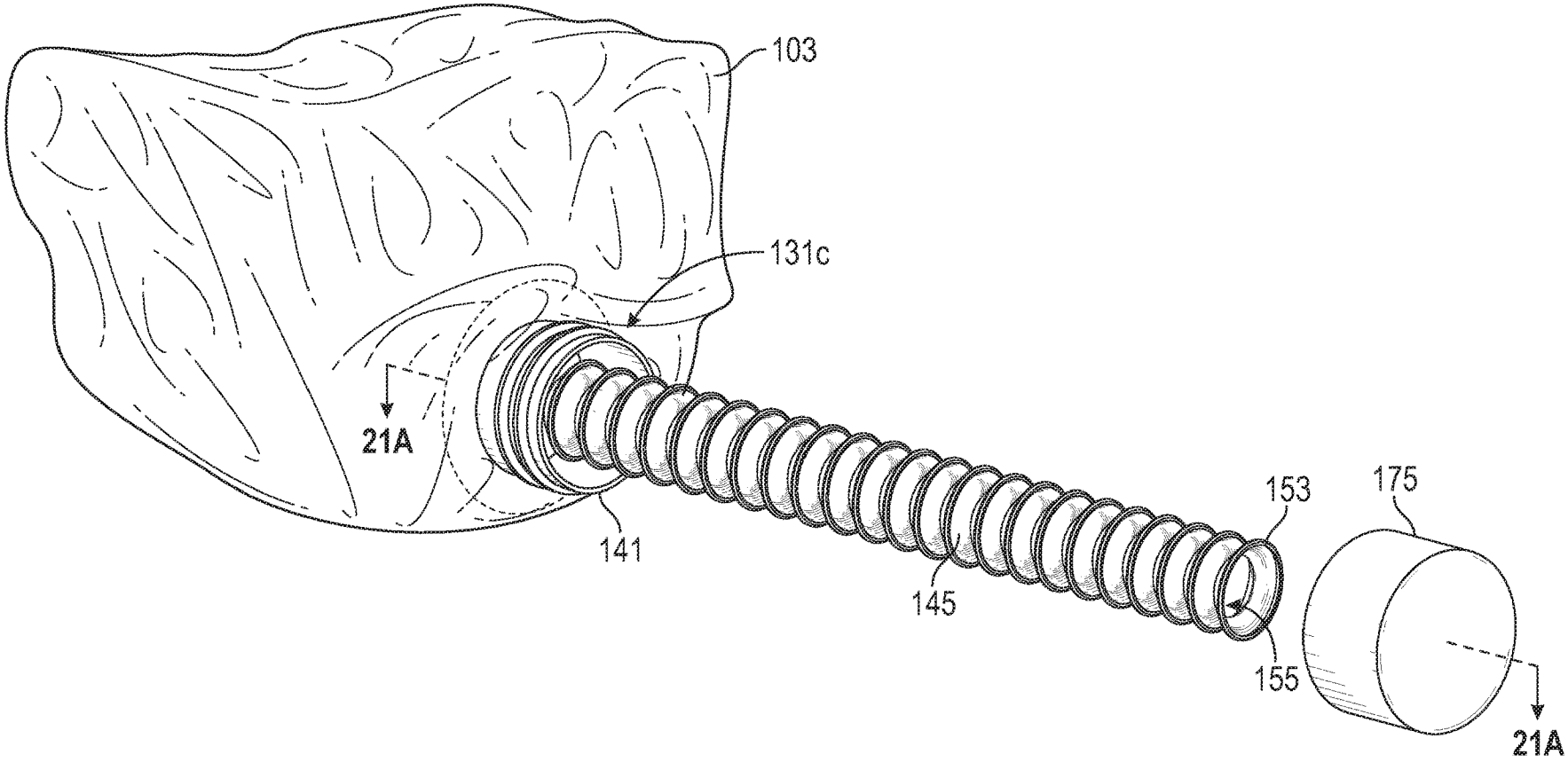
FIG. 21 is another embodiment of a pouring spout fitment and flexible container.
Figure 21A:
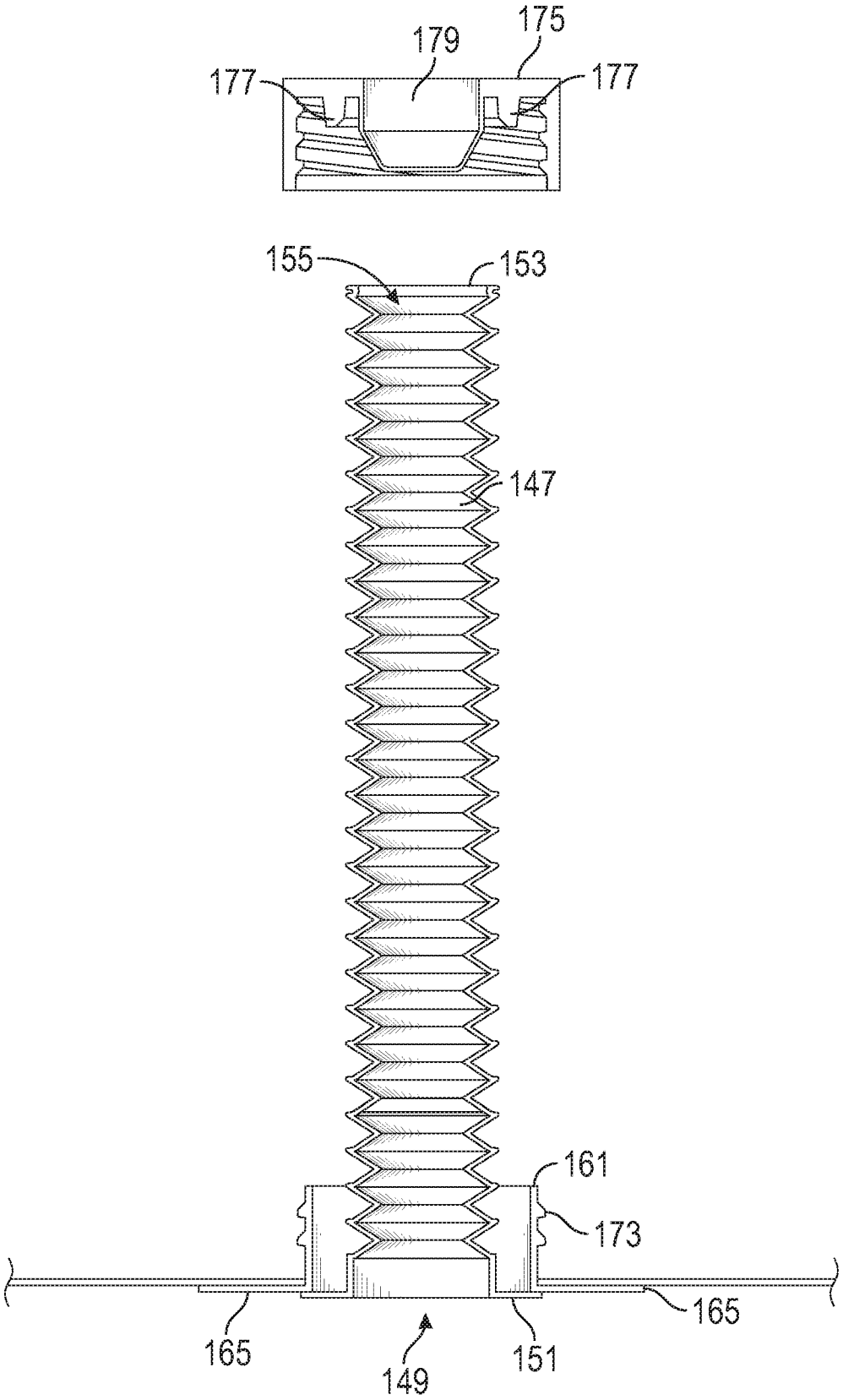
FIG. 21A is a cross-sectional view of the pouring spout fitment of FIG. 21.

FIGS. 21 and 21A illustrate a pouring spout fitment 131*c* for a flexible container 103. FIG. 21 depicts a cross-sectional view of the pouring spout fitment 131*c* of FIG. 21, taken along line A-A. The pouring spout fitment 131*c* includes a hollow rigid member 161. The pouring spout fitment 131*c* further includes an extendible spout 145 that is at least partially disposed in and connected to the hollow rigid member 161. In this embodiment, the extendible spout is connected to the bottom end of the hollow rigid member. The extendible spout 145 includes a proximal end 151 and a proximal opening 149, a distal end 153 and a distal opening 155, and a discharge passage 147. The proximal end 151 is connected to the hollow rigid member 161, the distal end 153 is configured to extend from and retract at least partially into the hollow rigid member 161, and the discharge passage 147 extends from the proximal opening 149 to the distal opening 155. The extendible spout is configured to extend between an extended position, wherein the distal end 153 extends from top end of the hollow rigid member 161, and a retracted position, wherein the distal end 153 retracts at least partially into the hollow rigid member 161. The extendible spout 147 is configured to dispense the pourable material from the flexible package 103 through the distal opening 155 when the hollow canoe portion 161 is attached to the inner surface of the flexible package 103. FIGS. 21 and 21A illustrate the extendible spout in an extended configuration.

The pouring spout fitment 131*c* further includes a removable lid 175, which is attached to the top end of the hollow rigid member 161 by threads 1624.

One-Gallon Box Optimized for Pallet Shipping

FIGS. 22-25 illustrate a 1-gallon outer box for a bag-in-box dispensing system according to an embodiment of the present disclosure. The outer box 201 includes a first bottom panel 205 having a front edge 267 and a back edge 269, a second bottom panel 207, which are designed to be adjacent to one another when the outer box 201 is assembled. Specifically, in some embodiments the second bottom panel 207 is configured to be glued to the first bottom panel 205, such that the first bottom panel 205 forms the inner surface of the outer box and the second bottom panel 207 is disposed on the outer surface of the outer box 201. Advantageously, in this embodiment the number of sharp edges in the interior of the outer box is minimized. The outer box 201 further includes a top panel 209 having a front edge 263 and a back edge 265.

The outer box 201 further includes a first side panel 211 having a top edge 213, a bottom edge 215, a front edge 217, and a back edge 219. The outer box 201 further includes a second side panel 221 having a top edge 223, a bottom edge 225, a front edge 227, and a back edge 229.

The outer box 201 further includes a first front panel 231 having a first flap perforation 233 and a second flap perforation 235, each connected to a substantially circular perforation 237 which includes a cut 239 forming a hole 241. In use, a user may insert a finger into the hole 241 to separate the substantially circular perforation 237, and may then raise a flap by separating the first and second flap perforations 233, 235. The fitment of a flexible package may then be removed through the flap, and secured in the circular perforation 237 for dispensing (not shown).

The outer box 201 further includes a second front panel 243 having a perforation 247 which extends from an edge 247 of the second front panel 243. When assembled, the second front panel 243 is adjacent the first front panel 231, such that the second front panel 243 forms the outer surface of the assembled outer box 201. Thus, a user may remove a portion of the second front panel 243 by separating the perforation 245, thereby exposing a portion of the first front panel 231 including the first and second flap perforations 233, 235, the substantially circular perforation 237, the cut 239 and the hole 241.

The outer box 201 further includes a first back panel 249, a second back panel 251, a third back panel 253, and a fourth back panel 255. When assembled, all of the back panels 249, 251, 253, and 255 may be adjacent or parallel to each other. In some embodiments, the first or second back panels 249, 251 may form the inner surface of the outer box 201, thereby advantageously minimizing the number of sharp edges which may contact the inner flexible package.

The outer box 201 further includes a plurality of handle perforations 257 configured to be partially or entirely removed by a user, thereby allowing a user to insert their fingers therethrough. The outer box 201 further includes a third front panel 259, and a fourth front panel 261. In some embodiments, when assembled the third and fourth front panels 261, 259 are disposed adjacent to an outer surface of the second front panel 243. This advantageously lends additional stability to the second front panel 243 when the perforation 245 is separated therefrom, and minimizes the number of sharp edges which may contact the inner flexible package.

Figure 22:
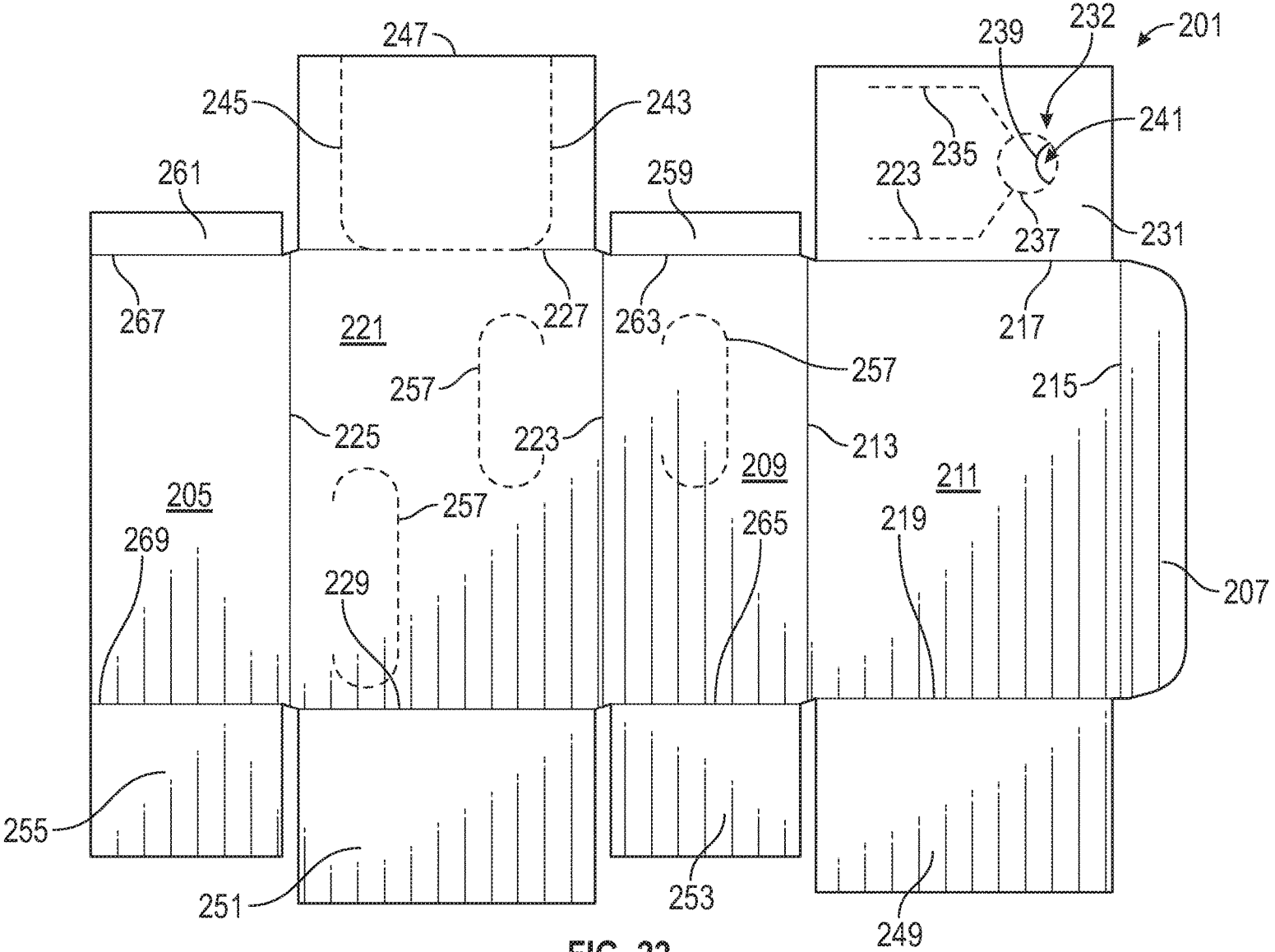
FIG. 22 is a disassembled outer box of a one gallon bag-in-box dispensing system according to another embodiment of the present disclosure.
Figure 23:
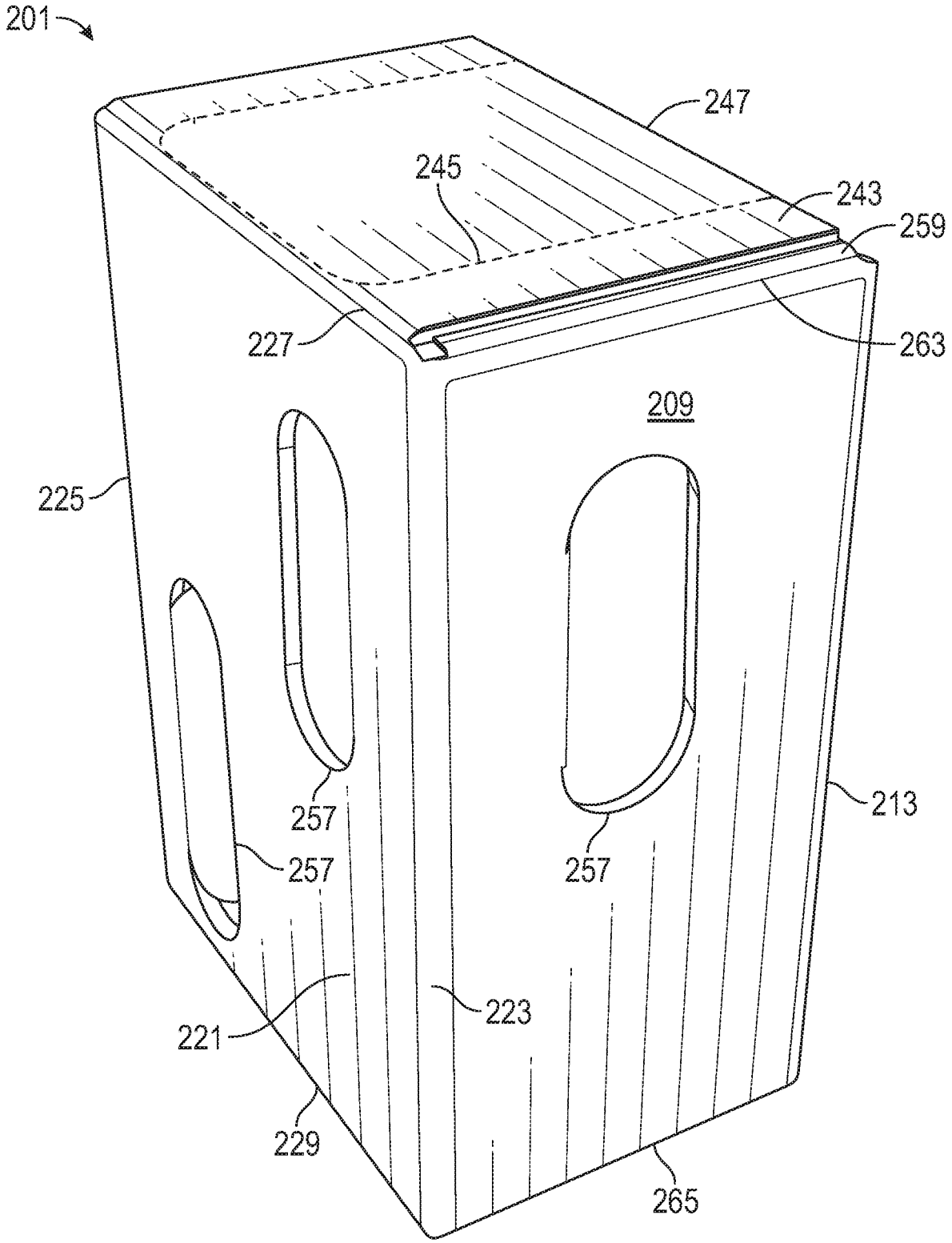
FIG. 23 is a perspective view of the outer box of FIG. 21 with a plurality of handle perforations separated.
Figure 24:
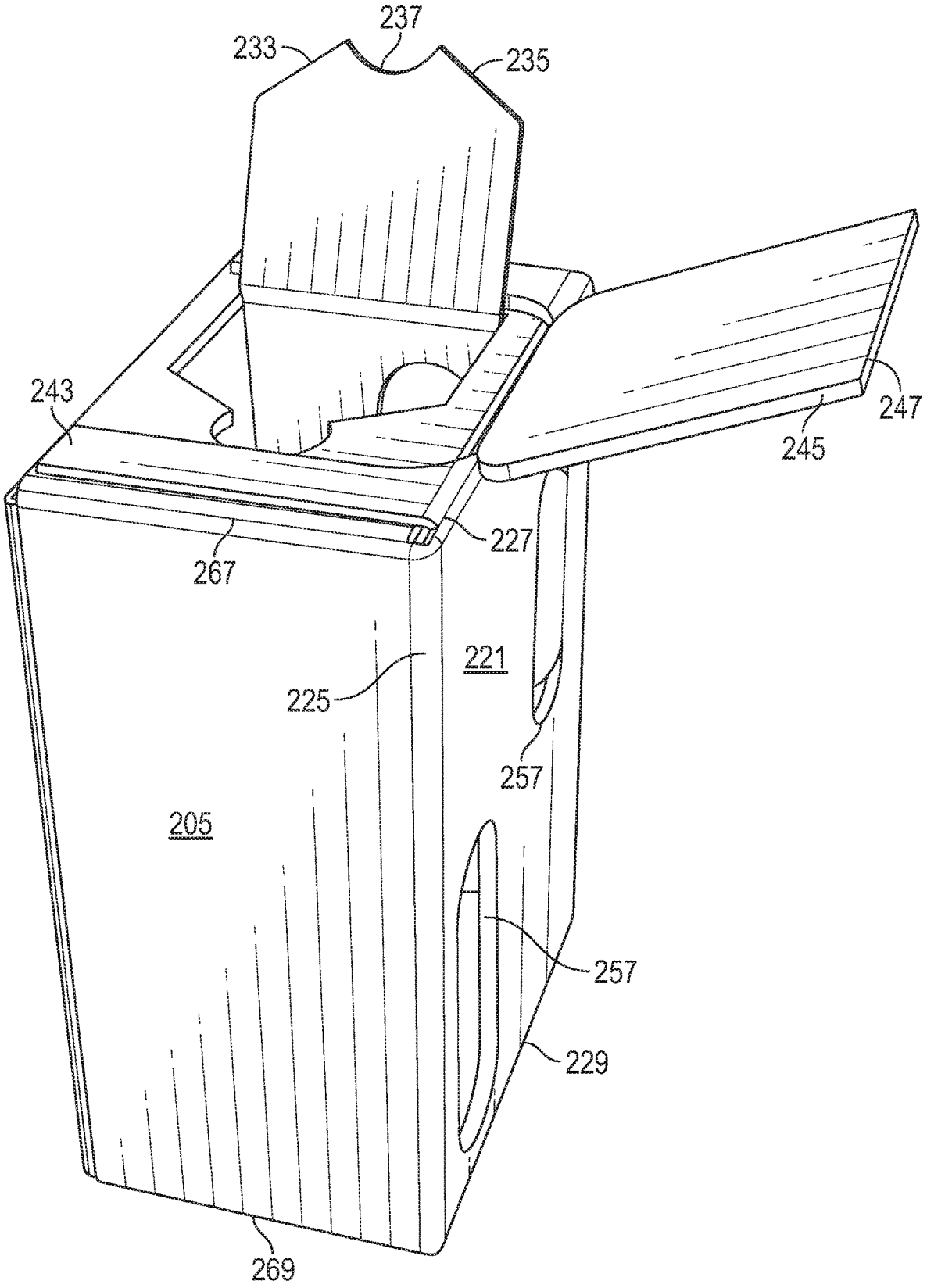
FIG. 24 is a perspective view of the outer box of FIG. 21 with a plurality of handle perforations separated, a portion of the second front panel separated at a perforation, and a portion of the first front panel separated at a substantially circular perforation and a first and second flap perforation.
Figure 25:
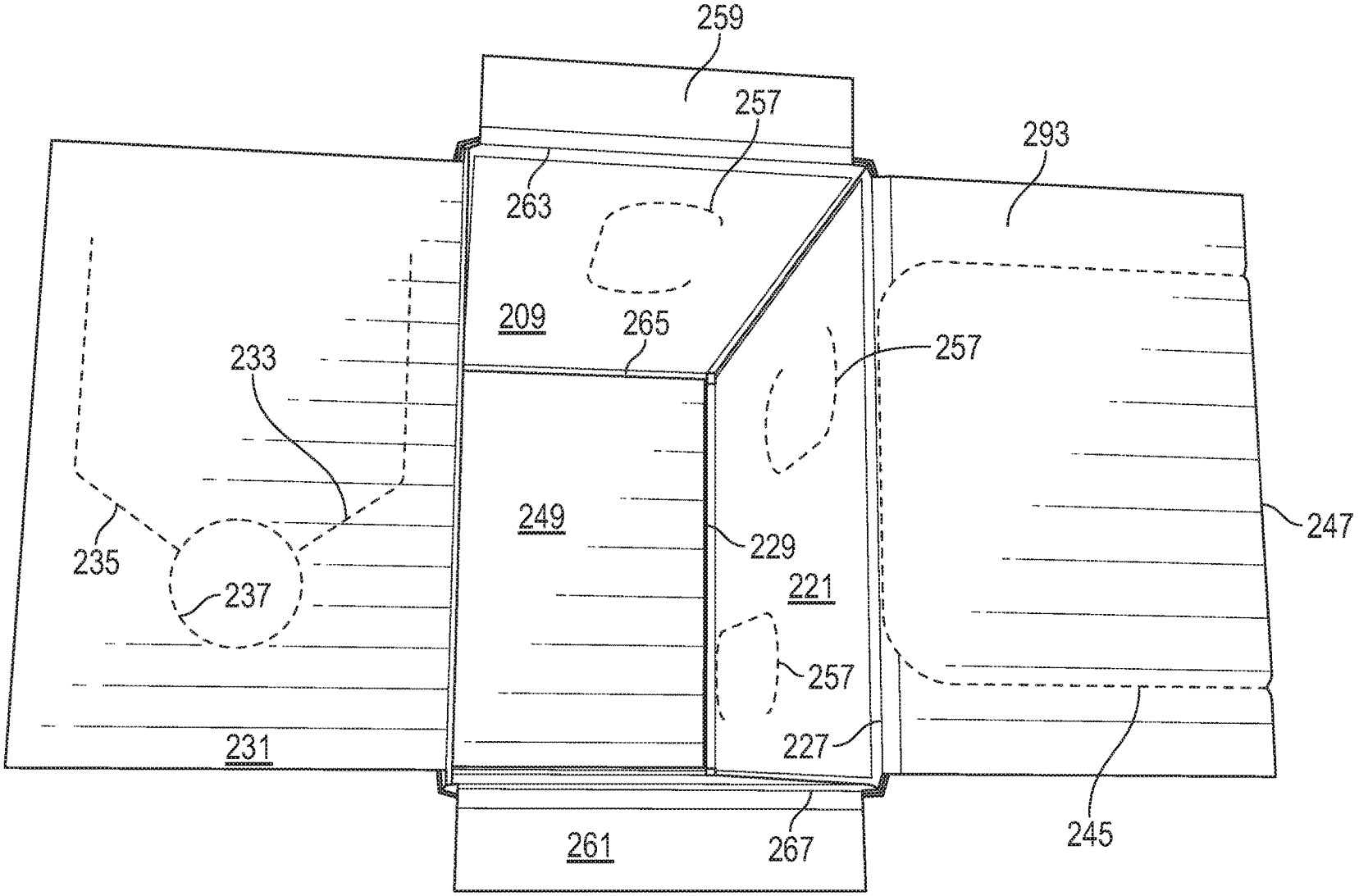
FIG. 25 is a perspective view of the outer box of FIG. 21 with the substantially circular perforation separated, and all of the front panels in an open configuration.

As can be seen from FIG. 22, the first side panel 211 is connected to the front panel 231 at the front edge 217, is connected to the first back panel 249 at the back edge 219, is connected to the top panel 209 at the top edge 213, and is connected to the second bottom panel 207 at the bottom edge 215. Specifically, the front panel 231, top panel 209, second bottom panel 207, and first back panel 249 are formed of one continuous piece of material at the front edge 217, back edge 219, top edge 213, and bottom edge 215 of the first side panel 211. Similarly, the top panel 209 is connected to the second side panel 221 at the top edge 223, and is connected to the third front panel 259 at its front edge 263 and the third back panel at its back edge 265. Specifically, the top panel 209, second side panel 221, third back panel 253, and third front panel 259 are formed of one continuous piece of material at the top edge 223, back edge 265 and front edge 263.

Similarly, the second side panel 221 is connected to the second front panel 243 at the front edge 227, is connected to the second back panel 251 at the back edge 229, and is connected to the first bottom panel 205 at the bottom edge 225. Specifically, the second side panel 221, second front panel 243, second back pane 1251, and first bottom panel 205 are formed of one continuous piece of material at the front edge 227, back edge 251, and bottom edge 225. Finally, the first bottom panel 205 is connected to the fourth front panel 261 at the front edge 267 and is connected to the fourth back panel 255 at the back edge 269. Specifically, the first bottom panel 205, fourth front panel 261, and fourth back panel 255 are formed of one continuous piece of material at the front edge 267 and back edge 267.

One of skill in the art would readily understand that the relative panels described herein could be arranged in a variety of ways to arrive at a one gallon box having the first and second front panels, top panel, bottom panel, and first and second side panels described herein. That is, in some embodiments, these panels may be connected to one another in a different configuration than illustrated in FIGS. 22-25.

The box illustrated in FIGS. 22-25 may be optimized for pallet shipping. That is, the outer dimensions of the box may be configured to maximize the number of one gallon boxes which can be placed on a standard shipping pallet. For example, up to 240 of these boxes may be shipped on a single pallet-40% more units per pallet than a one gallon standard rigid container. In order to achieve this optimum packing efficiency, the outer dimensions of the box may be configured so that an integer of boxes will fit in both the width and depth of the pallet, and the boxes may be made from a material which allows the boxes to be stacked on top of one another. As a result of this optimum packing, these one gallon containers require 40% less warehouse space than comparative one gallon rigid containers. Further, the use of a flexible bag-in-box design results in a reduction of plastic of about 48.6% less plastic being used than in comparative rigid one gallon containers, and requires about 87.6% fewer pallets than comparative rigid one gallon containers for the same volume of product. Specifically, the outer box may have dimensions of 10⅝ inches by 7¼ inches by 4½ inches to pack efficiently on a standard 48 inch×48 inch pallet.

2.5-Gallon Box Optimized for Pallet Shipping

FIGS. 26-29 illustrate a 2.5-gallon outer box for a bag-in-box dispensing system according to an embodiment of the present disclosure. The outer box 301 includes a bottom panel 305 having a front edge 313 and a back edge 315, a first top panel 307 having a front edge 321, a back edge 323, a first side edge 325, and a second side edge 327. The outer box 301 further includes a first side panel 309 having a front edge 349, a back edge 351, and a top edge 353, and a second side panel 311 having a front edge 355 and a back edge 357.

The outer box 301 further includes a first front panel 329 having a perforation 331 including a first flap perforation 333 and a second flap perforation 335, each connected to a substantially circular perforation 337 which includes a cut 339 forming a hole 341. In use, a user may insert a finger into the hole 341 to separate the substantially circular perforation 334, and may then raise a flap by separating the first and second flap perforations 333, 335. The fitment of a flexible package may then be removed through the flap, and secured in the circular perforation 337 for dispensing (not shown).

The outer box 301 further includes a second front panel 343 having a perforation 345 which extends from an edge 347 of the second front panel 343. When assembled, the second front panel 343 is adjacent the first front panel 329, such that the second front panel 343 forms the outer surface of the assembled outer box 301. Thus, a user may remove a portion of the second front panel 343 by separating the perforation 345, thereby exposing a portion of the first front panel 329 including the first and second flap perforations 333, 335, the substantially circular perforation 337, the cut 339 and the hole 341.

The outer box 301 further includes a second top panel 359, which is designed to be adjacent to the first top panel 307 when the outer box 301 is assembled. Specifically, in some embodiments the first top panel 307 is configured to be glued to the second top panel 359 so that the first top panel 307 forms the inner surface of the box and the second top panel 359 is disposed on the outer surface of the outer box 301. Advantageously, in this embodiment the number of sharp edges in the interior of the box is minimized.

The outer box 301 further includes a third front panel 361, a fourth front panel 363. When assembled, all of the front panels 329, 343, 361, and 363 may be adjacent or parallel to each other. In some embodiments, the first or second front panels 329, 343 may form the inner surface of the outer box 301, thereby advantageously minimizing the number of sharp edges which may contact the inner flexible package.

The outer box 301 further includes a plurality of handle perforations 373 configured to be partially or entirely removed by a user, thereby allowing a user to insert their fingers therethrough.

Figure 26:
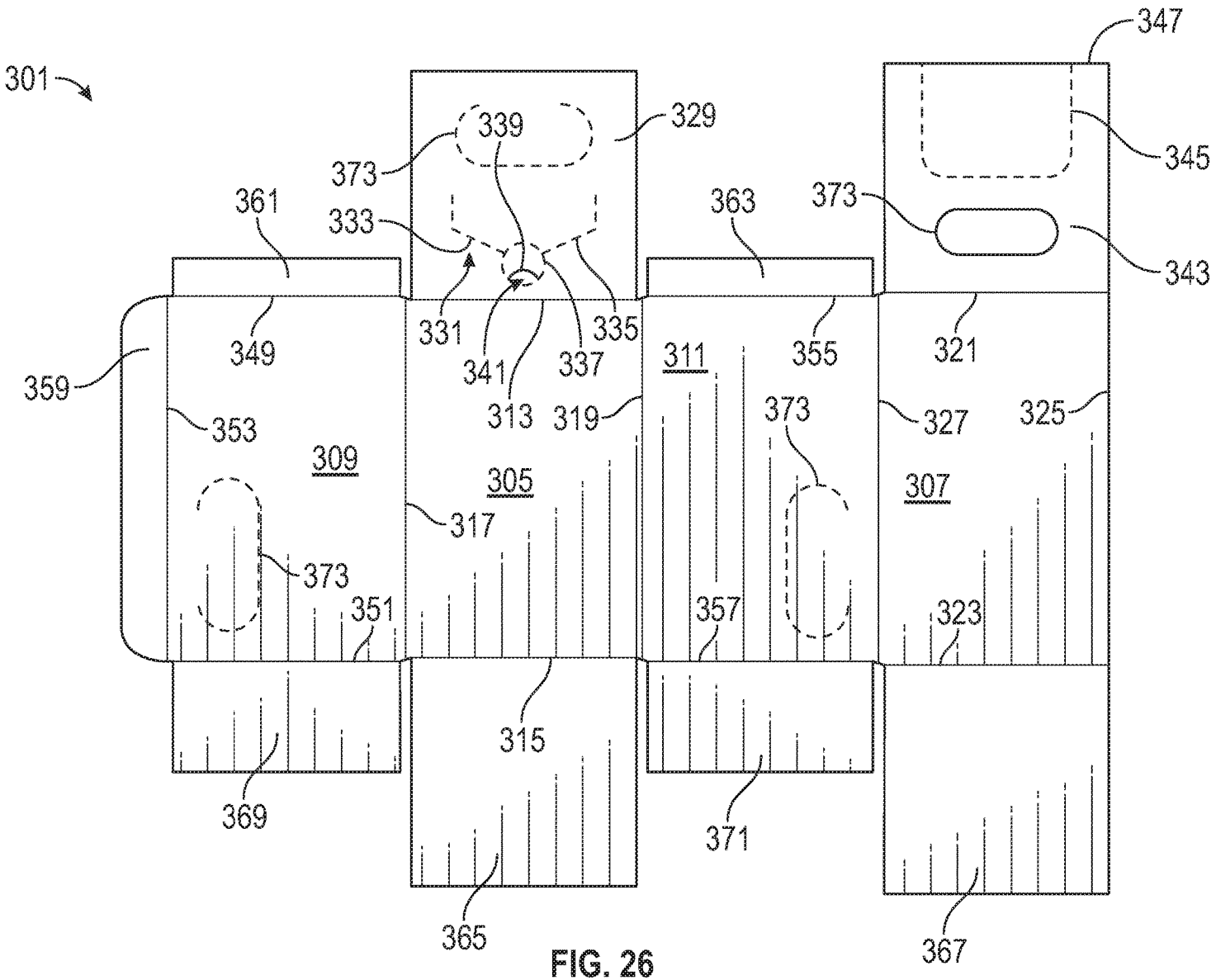
FIG. 26 is a disassembled outer box of a 2.5 gallon bag-in-box dispensing system according to another embodiment of the present disclosure.
Figure 27:
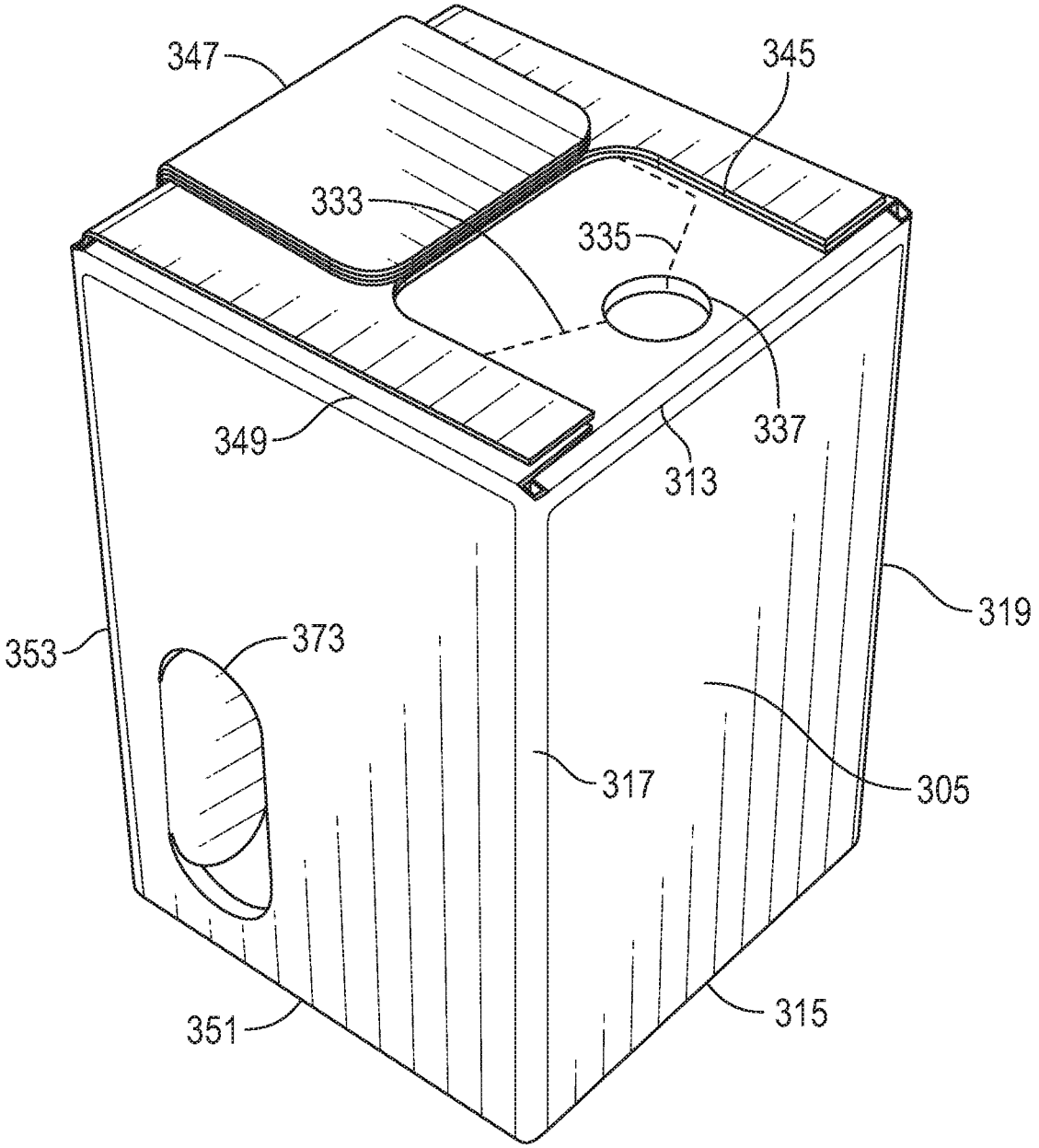
FIG. 27 is a view of the outer box of FIG. 26 with the perforation in the second front panel partially separated, the circular perforation in the first front panel completely separated, and a handle perforation in the first side panel separated.
Figure 28:
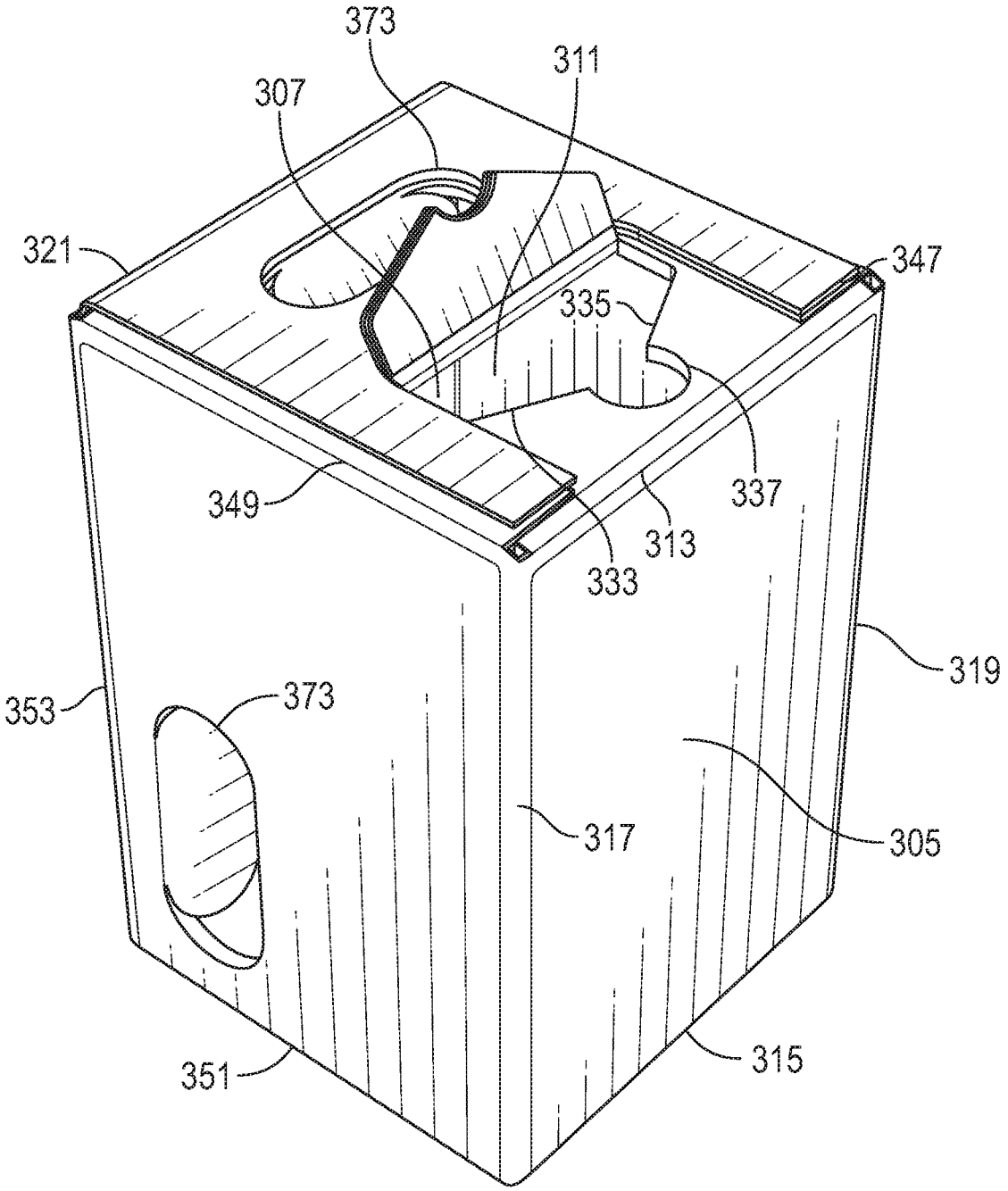
FIG. 28 is a view of the outer box of FIG. 27 with the perforation in the second front panel completely separated, the first and second flap perforations in the first front panel separated, and the handle perforation in the second front panel separated.
Figure 29:
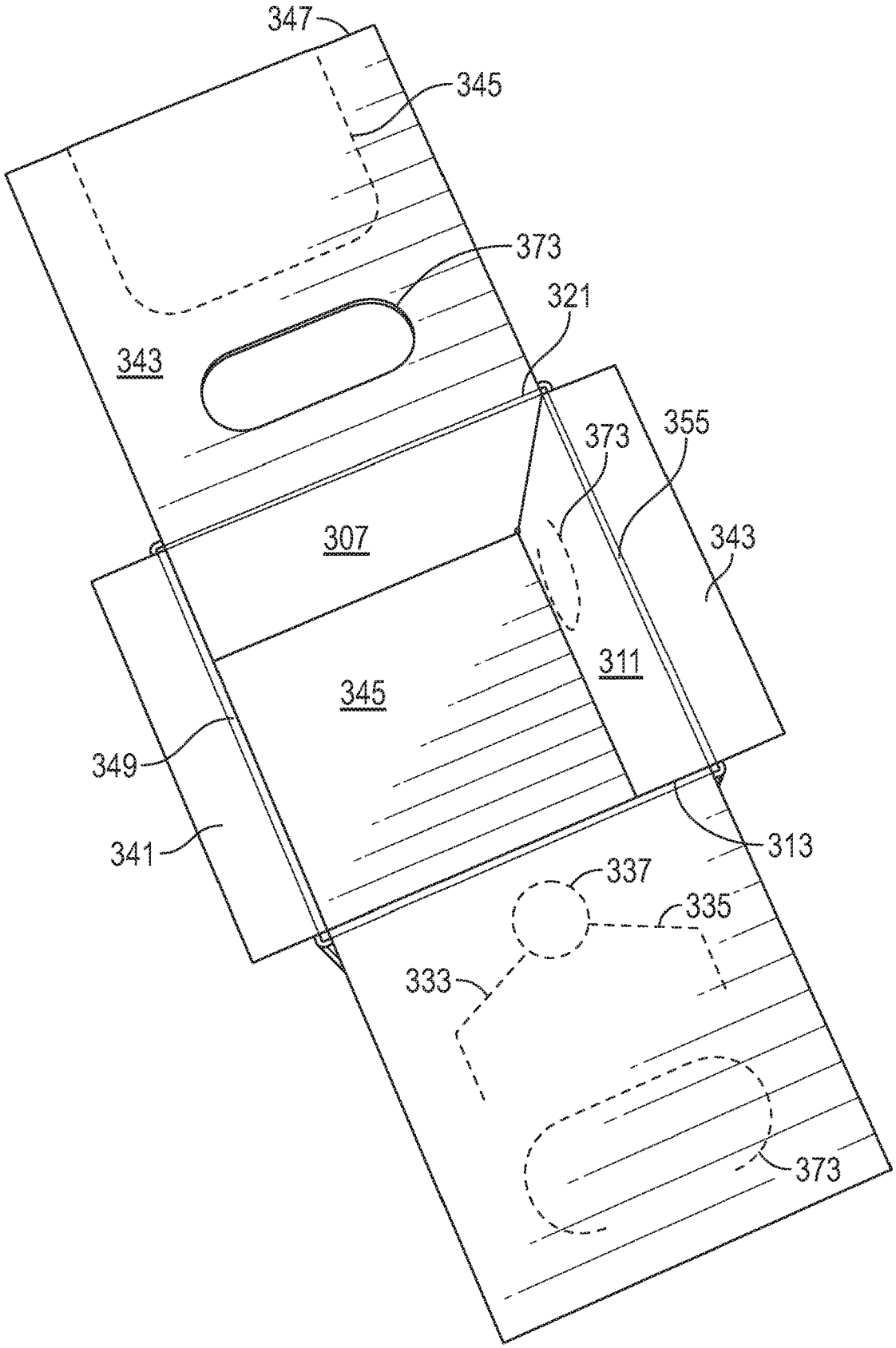
FIG. 29 is a view of the outer box of FIG. 26 with the first, second, third, and fourth front panels open.

As can be seen from FIG. 26, the first top panel 307 is connected to the second front panel 343 at the front edge 321, is connected to the second side panel 311 at the side edge 327, and is connected to the second back panel 367 at the back edge 323. Specifically, the first top panel 307, second front panel 343, second side panel 311, and second back panel 367 are formed of one continuous piece of material at the front edge 321, side edge 327, and back edge 323. Similarly, the bottom panel 305 is connected to the first front panel 329 at the front edge 313, is connected to the first back panel 365 at the back edge 315, is connected to the first side panel 309 at the first side edge 317, and is connected to the second side panel 311 at the second side edge 319. Specifically, the bottom panel 305, first front panel 329, first back panel 365, first side panel 309, and second side panel 311 are formed of one continuous piece of material at the front edge 313, first side edge 317, second side edge 319, and back edge 315.

Similarly, the first side panel 309 is connected to the third front panel 361 at the front edge 349, is connected to the second top panel 359 at the top edge 353, and is connected to the third back panel 369 at the back edge 351. That is, in some embodiments, the first side panel 309, the second top panel 359, the third front panel 361, and the third back panel 369 are formed of one continuous piece of material at the front edge 349, first side edge 353, and back edge 351. Finally, the second side panel 311 is connected to the fourth front panel 363 at the front edge 355 and is connected to the fourth back panel 371 at the back edge 357.

One of skill in the art would readily understand that the relative panels described herein could be arranged in a variety of ways to arrive at a one gallon box having the first and second front panels, top panel, bottom panel, and first and second side panels described herein. That is, in some embodiments, these panels may be connected to one another in a different configuration than illustrated in FIGS. 26-29.

The box illustrated in FIGS. 26-29 may be optimized for pallet shipping. That is, the outer dimensions of the box may be configured to maximize the number of two and a half gallon boxes which can be placed on a standard shipping pallet. For example, up to 120 of these boxes may be shipped on a single pallet-33% more units per pallet than a standard two and a half gallon rigid container. In order to achieve this optimum packing efficiency, the outer dimensions of the box may be configured so that an integer of boxes will fit in both the width and depth of the pallet, and the boxes may be made from a material which allows the boxes to be stacked on top of one another. As a result of this optimum packing, these two and a half gallon containers require 33% less warehouse space than comparative two and a half gallon rigid containers. Further, the use of a flexible bag-in-box design results in a reduction of plastic of about 69% less plastic being used than in comparative rigid two and a half gallon containers, and requires about 67.7% fewer pallets than comparative rigid two and a half gallon containers for the same volume of product. Specifically, the outer box may have dimensions of 7 13/16 inches by 7½ inches by 12 3/16 inches to pack efficiently on a standard 48 inch×48 inch pallet.

5 Gallon Box Optimized for Pallet Shipping

FIGS. 30-34 illustrate a 5-gallon outer box for a bag-in-box dispensing system according to an embodiment of the present disclosure. The outer box 401 includes a bottom panel 405 having a front edge 413, a back edge 415, a first side edge 417, and a second side edge 419. The outer box 401 further includes a top panel 407 having a front edge 421, a back edge 423, a first side edge 425, and a second side edge 427. The outer box 401 further includes a first side panel 409 having a front edge 449, a back edge 451, and a top edge 453, and a second side panel 411 having a front edge 455 and a back edge 457.

The outer box 401 further includes a first front panel 429 having a perforation 431 including a first flap perforation 433 and a second flap perforation 435, each connected to a substantially circular perforation 437 which includes a cut 439 forming a hole 441. In use, a user may insert a finger into the hole 441 to separate the substantially circular perforation 434, and may then raise a flap by separating the first and second flap perforations 433, 435. The fitment of a flexible package may then be removed through the flap, and secured in the circular perforation 437 for dispensing (not shown).

The outer box 401 further includes a second front panel 443 having a perforation 445 which extends from an edge 447 of the second front panel 443. When assembled, the second front panel 443 is adjacent the first front panel 429, such that the second front panel 443 forms the outer surface of the assembled outer box 401. Thus, a user may remove a portion of the second front panel 443 by separating the perforation 445, thereby exposing a portion of the first front panel 429 including the first and second flap perforations 433, 435, the substantially circular perforation 437, the cut 439 and the hole 441.

The outer box 401 further includes a third side panel 459, which is designed to be adjacent to the second side panel 411 when the outer box 401 is assembled. Specifically, in some embodiments the third side panel 459 is configured to be glued to the second side panel 411 so that the second side panel 411 forms the inner surface of the box and the third side panel 459 is disposed on the outer surface of the outer box 401. Advantageously, in this embodiment the number of sharp edges in the interior of the box is minimized.

The outer box 401 further includes a third front panel 461, a fourth front panel 463. When assembled, all of the front panels 429, 443, 461, and 463 may be adjacent or parallel to each other. In some embodiments, the first or second front panels 429, 443 may form the inner surface of the outer box 301, thereby advantageously minimizing the number of sharp edges which may contact the inner flexible package.

The outer box 401 further includes a plurality of handle perforations 473 configured to be partially or entirely removed by a user, thereby allowing a user to insert their fingers therethrough.

Figure 30:
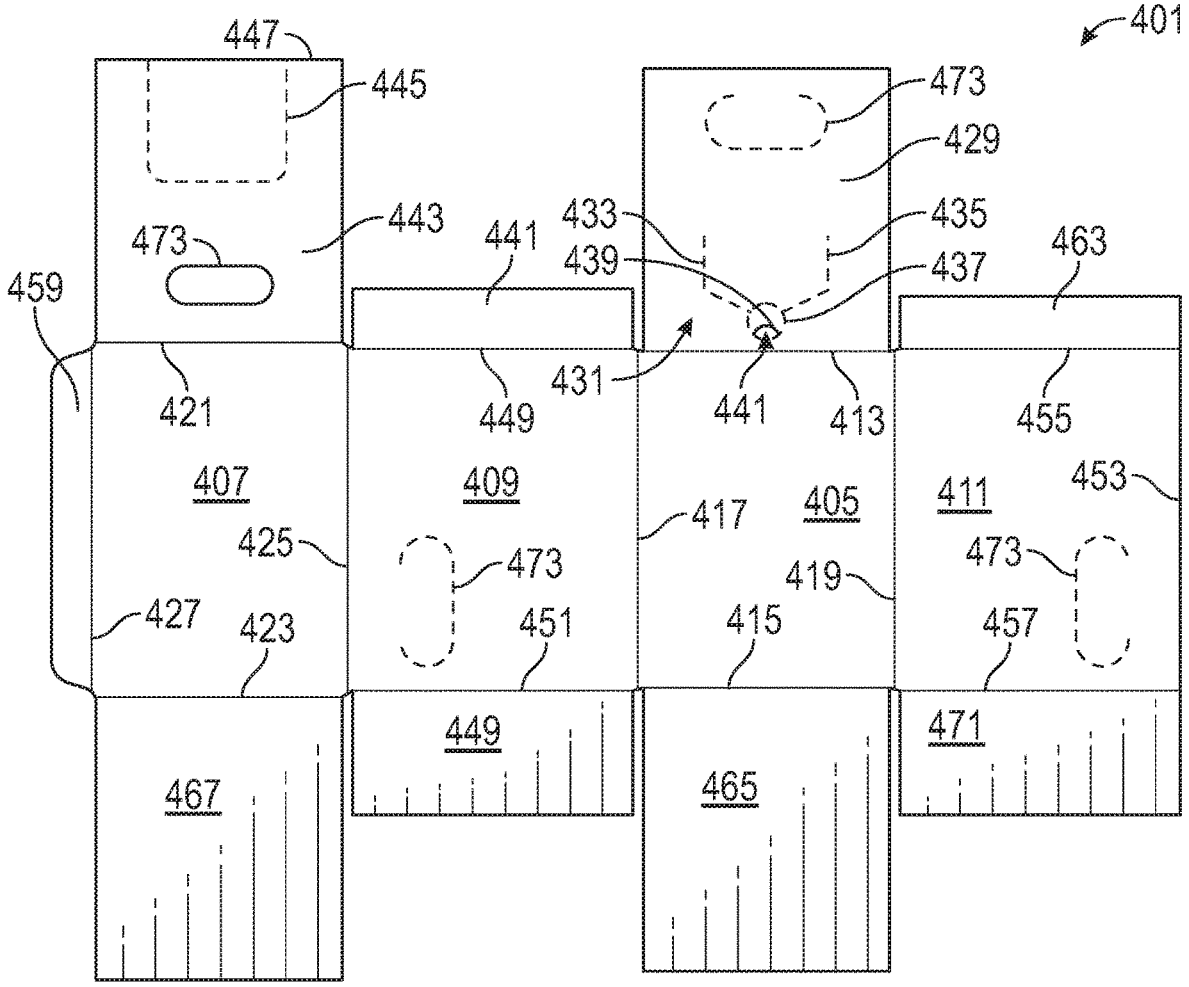
FIG. 30 is a disassembled outer box of a 5 gallon bag-in-box dispensing system according to another embodiment of the present disclosure.
Figure 31:
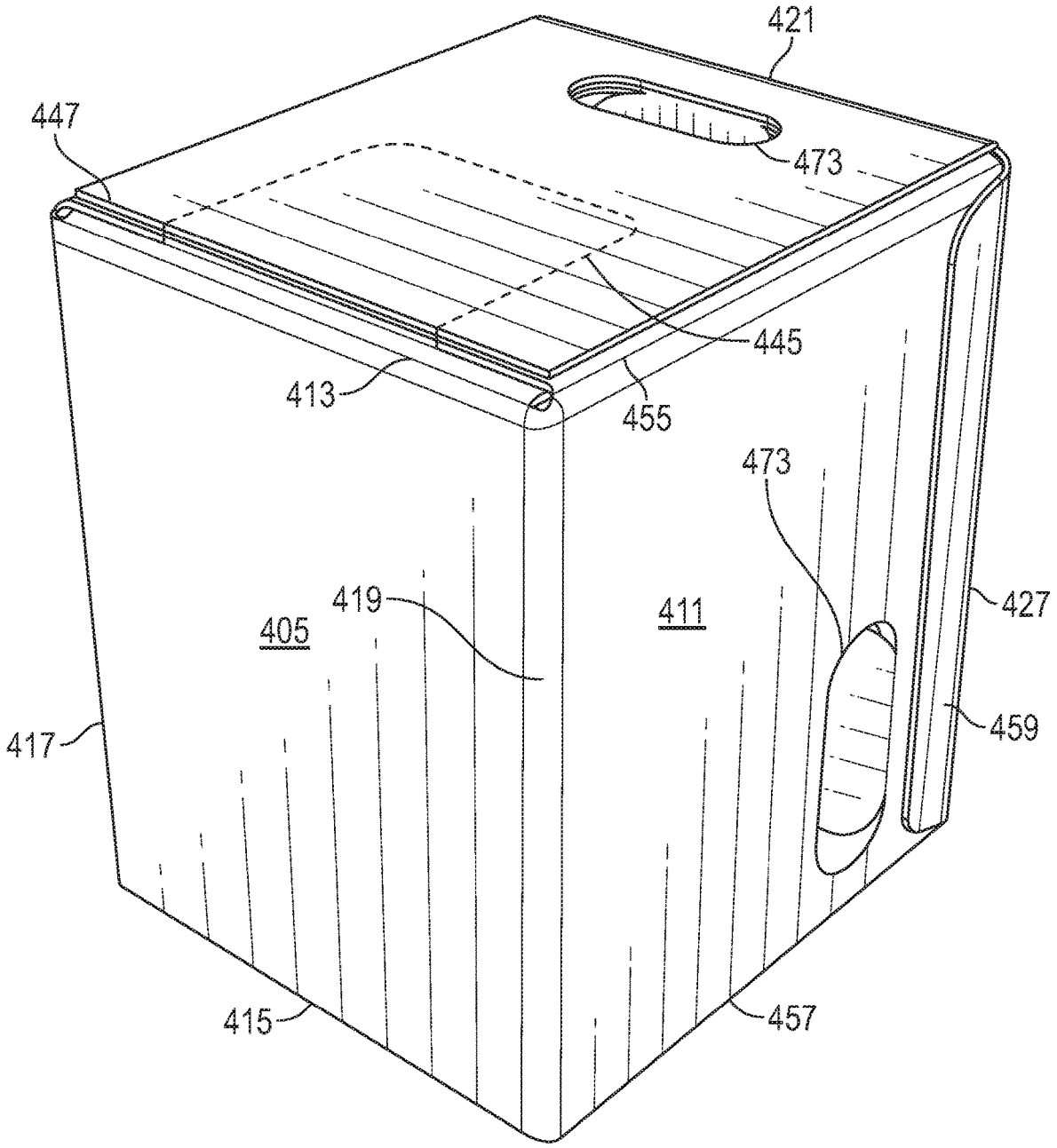
FIG. 31 is a perspective view of the assembled outer box of FIG. 30 with the handle perforations in the second front panel and second side panel separated.
Figure 32:
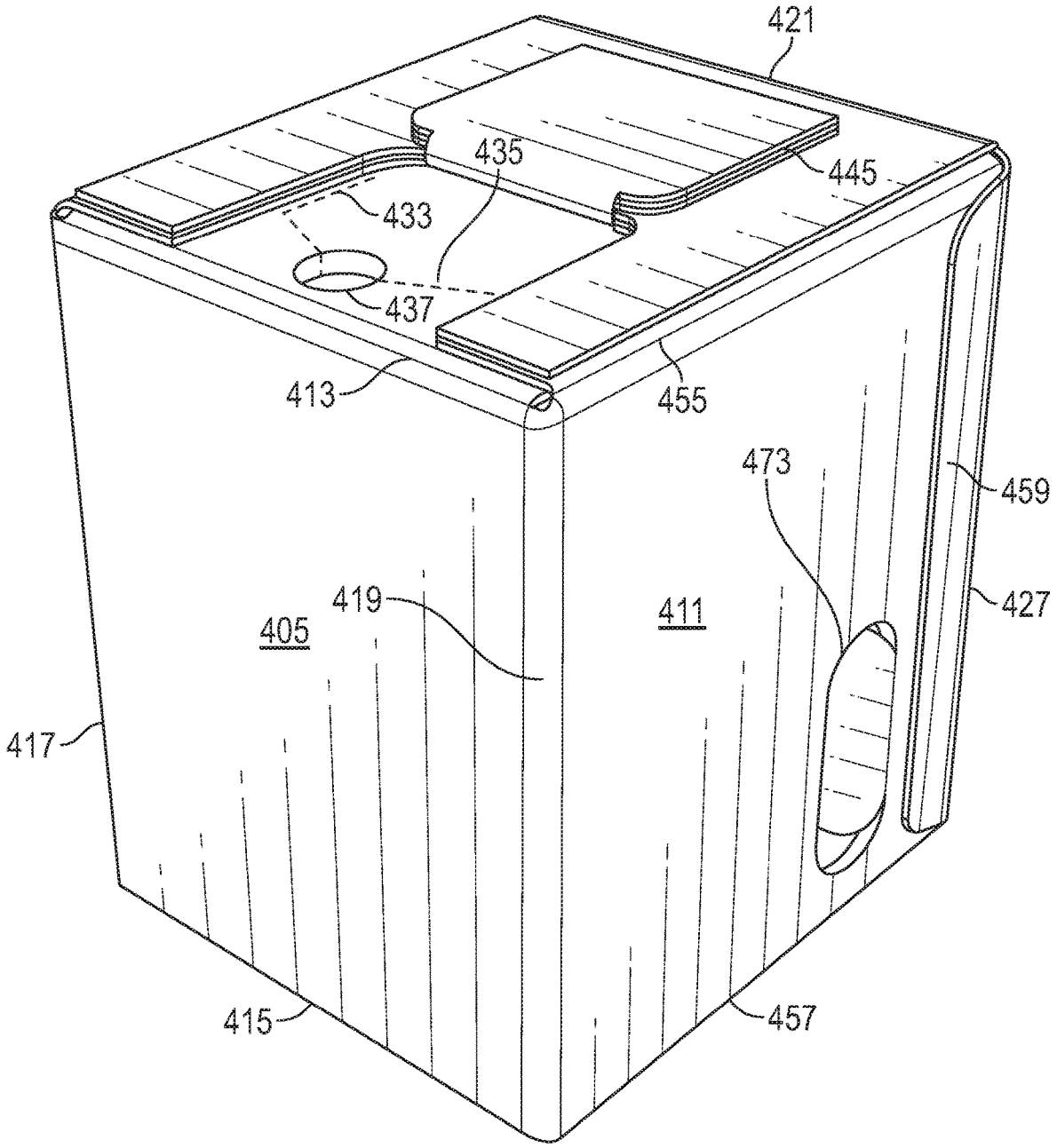
FIG. 32 is a view of the assembled outer box of FIG. 31 with the perforation in the second front panel partially separated, the substantially circular perforation in the first front panel completely separated, and the handle perforation in the second side panel separated.
Figure 33:
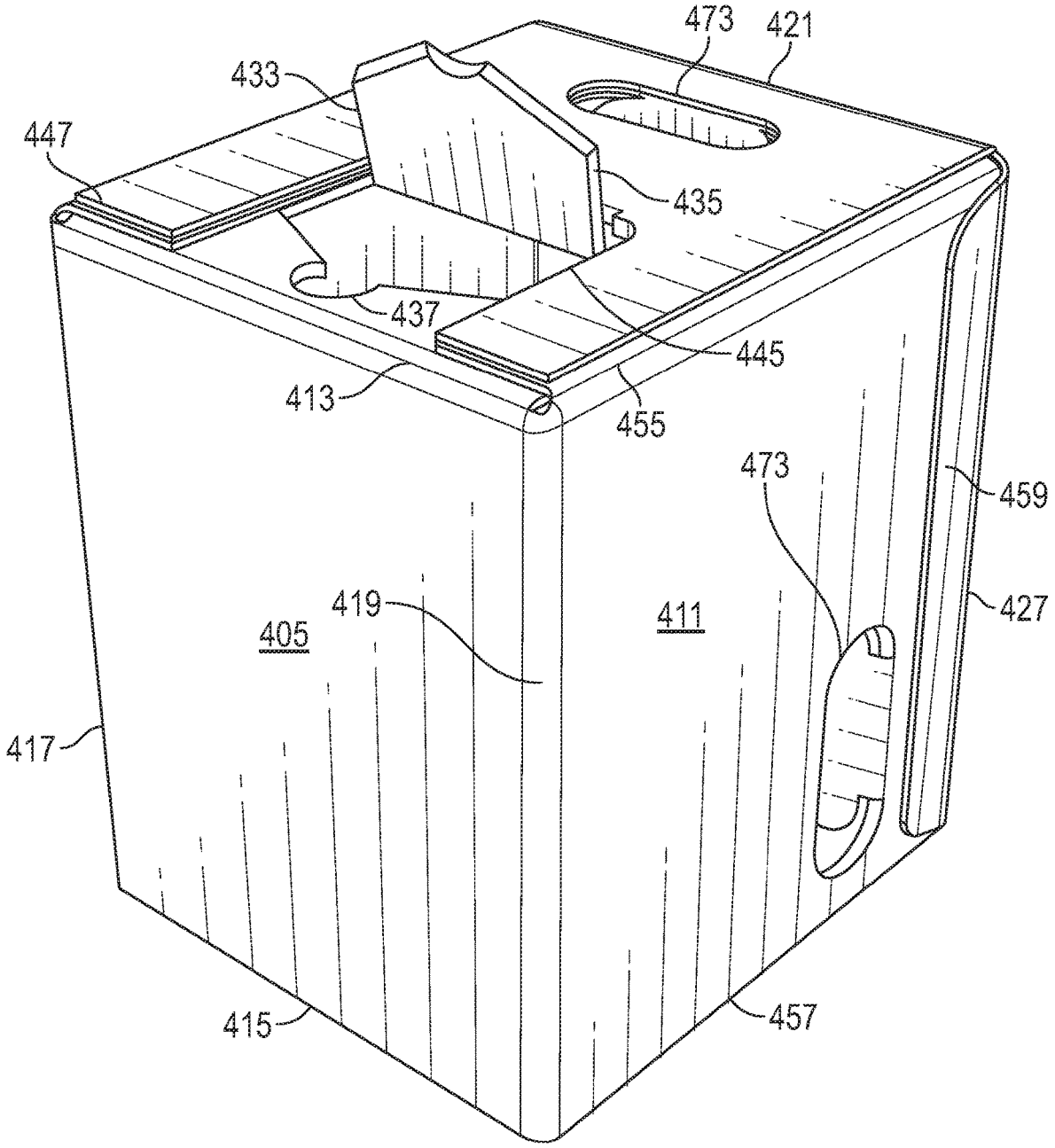
FIG. 33 is a view of the outer box of FIG. 32 with the perforation in the second front panel completely separated, the first and second flap perforations separated, and the handle perforation in the first front panel separated.
Figure 34:
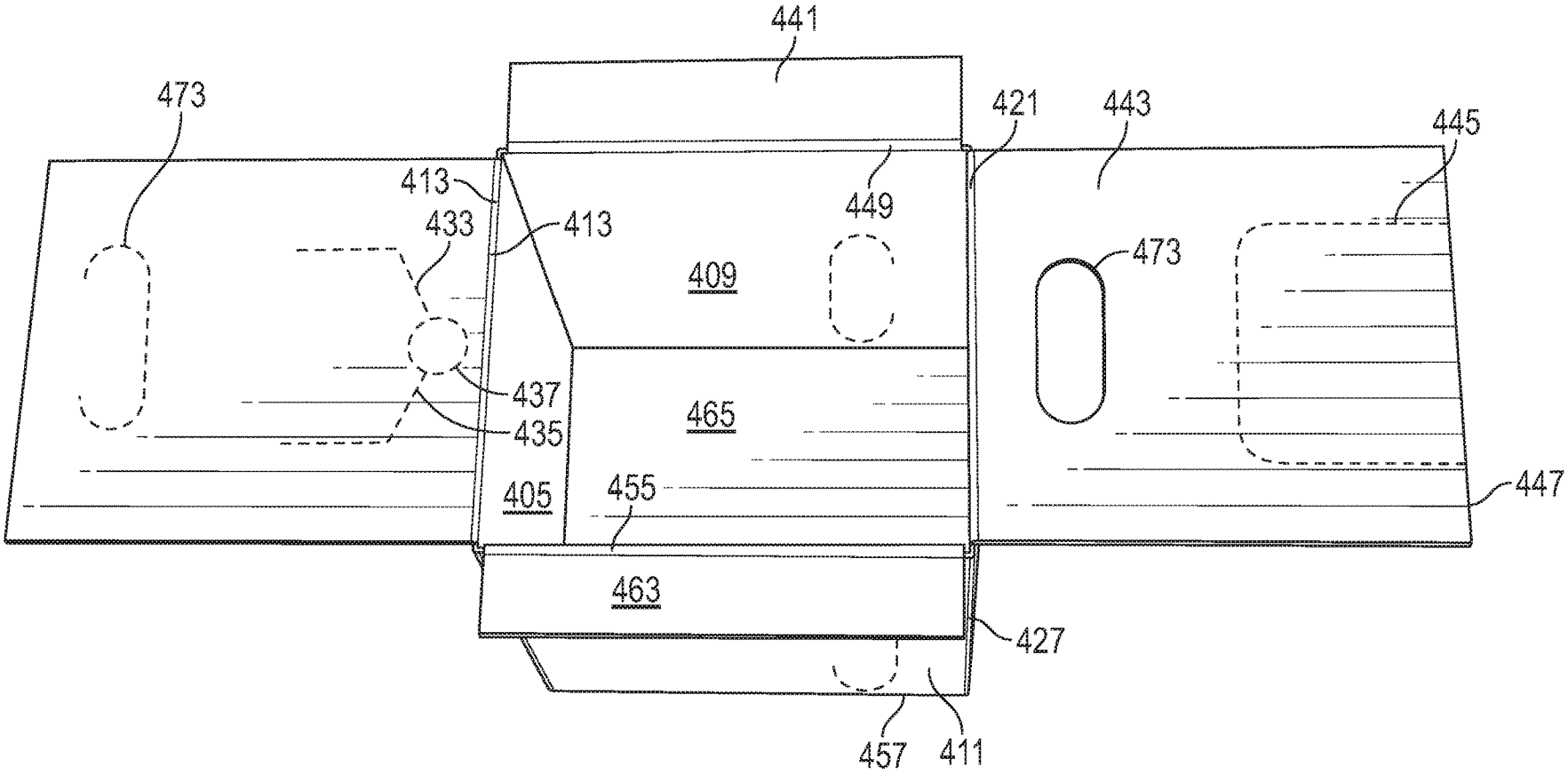
FIG. 34 is a view of the outer box of FIG. 30 with the first front panel, second front panel, and third front panels open.

As can be seen from FIG. 30, the first top panel 407 is connected to the second front panel 443 at the front edge 421, is connected to the first side panel 409 at the side edge 425, is connected to the third side panel 459 at the second side edge 427, and is connected to the second back panel 467 at the back edge 423. Specifically, the first top panel 407, second front panel 443, first side panel 309, third side panel 459, and second back panel 367 are formed of one continuous piece of material at the front edge 421, first side edge 425, second side edge 427, and back edge 423. Similarly, the bottom panel 405 is connected to the first front panel 429 at the front edge 413, is connected to the first back panel 465 at the back edge 415, is connected to the first side panel 409 at the first side edge 417, and is connected to the second side panel 411 at the second side edge 419. Specifically, the bottom panel 405, first front panel 429, first back panel 465, first side panel 409, and second side panel 411 are formed of one continuous piece of material at the front edge 413, first side edge 417, second side edge 419, and back edge 415.

Similarly, the first side panel 409 is connected to the third front panel 461 at the front edge 449, and is connected to the third back panel 469 at the back edge 451. That is, in some embodiments, the first side panel 409, the third front panel 461, and the third back panel 469 are formed of one continuous piece of material at the front edge 449 and back edge 451. Finally, the second side panel 411 is connected to the fourth front panel 463 at the front edge 455, and is connected to the fourth back panel 471 at the back edge 457.

One of skill in the art would readily understand that the relative panels described herein could be arranged in a variety of ways to arrive at a one gallon box having the first and second front panels, top panel, bottom panel, and first and second side panels described herein. That is, in some embodiments, these panels may be connected to one another in a different configuration than illustrated in FIGS. 30-34.

The box illustrated in FIGS. 30-34 may be optimized for pallet shipping. That is, the outer dimensions of the box may be configured to maximize the number of two and a half gallon boxes which can be placed on a standard shipping pallet. For example, up to 64 of these boxes may be shipped on a single pallet-25% more units per pallet than a standard five gallon rigid container. In order to achieve this optimum packing efficiency, the outer dimensions of the box may be configured so that an integer of boxes will fit in both the width and depth of the pallet, and the boxes may be made from a material which allows the boxes to be stacked on top of one another. As a result of this optimum packing, these five gallon containers require 25% less warehouse space than comparative five gallon rigid containers. Further, the use of a flexible bag-in-box design results in a reduction of plastic of about 85.3% less plastic being used than in comparative rigid two and a half gallon containers, and requires about 57.7% fewer pallets than comparative rigid two and a half gallon containers for the same volume of product. Specifically, the outer box may have dimensions of 11⅛ inches by 9 13/16 inches by 13⅜ inches to pack efficiently on a standard 48 inch×48 inch pallet.

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A bag-in-box dispensing system comprising:

an outer box enclosing an inner flexible container including a fitment, wherein the outer box comprises:

a first top panel;

a first bottom panel opposite the first top panel;

a first side panel comprising a top edge, a bottom edge, a front edge, and a back edge;

a second side panel opposite the first side panel comprising a top edge, a bottom edge, a front edge, and a back edge;

a first front panel comprising a substantially circular perforation and a partially separable flap configured to allow a user to separate a portion of the first front panel, expose the dispensing system, secure a portion of the dispensing system in the substantially circular perforation, and rejoin the partially separable flap so that the substantially circular perforation may operate to keep the dispensing system fixed within the outer box;

a second front panel disposed adjacent to the first front panel, such that the second front panel forms the outer surface of the box, wherein the second front panel comprises a perforation extending from an edge of the second front panel and configured to allow a portion of the second front panel to be removed, thereby exposing the substantially circular perforation and the partially separable flap in the first front panel; and a first back panel opposite the first and second front panels.

2. The bag-in-box dispensing system of claim 1, wherein the outer box further comprises at least one handle perforation in one or more of the first top panel, first side panel, second side panel, first front panel, or second front panel.

3. The bag-in-box dispensing system of claim 1, wherein the outer box further comprises a second back panel connected to the second side panel at the back edge of the second side panel, a third back panel connected to the back edge of the first side panel, and a fourth back panel connected to the back edge of the second side panel.

4. The bag-in-box dispensing system of claim 1, wherein the outer box further comprises a third front panel connected to the front edge of the first side panel and a fourth front panel connected to the front edge of the second side panel.

5. The bag-in-box dispensing system of claim 3, wherein the third and fourth back panels are disposed adjacent to the first and second back panels.

6. The bag-in-box dispensing system of claim 4, wherein the third and fourth front panels are disposed adjacent to the first and second front panels.

7. The bag-in-box dispensing system of claim 3, wherein:

the first bottom panel is connected to the bottom edge of the second side panel;

the first front panel is connected to the front edge of the first side panel; the second front panel is connected to the front edge of the second side panel and disposed adjacent to the first front panel; and the first back panel is connected to the first side panel at the back edge of the first side panel.

8. The bag-in-box dispensing system of claim 7, wherein the outer box further comprises:

a second back panel connected to the second side panel at the back edge of the second side panel; and a second bottom panel connected to the bottom edge of the first side panel and adjacent to the first bottom panel.

9. The bag-in-box dispensing system of claim 7, wherein the second bottom panel is disposed adjacent to the first bottom panel, and wherein the third and fourth back panels are disposed adjacent to the first and second back panels.

10. The bag-in-box dispensing system of claim 7, wherein the box comprises one or more handle perforations in each of the first top panel and the second side panel.

11. The bag-in-box dispensing system of claim 1, wherein:

the first bottom panel comprises a front edge and a back edge; the first top panel comprises a front edge and a back edge;

the first bottom panel is connected to the bottom edge of the second side panel and is connected to the bottom edge of the first side panel;

the first top panel is connected to the top edge of the second side panel; the first front panel is connected to the front edge of the first bottom panel; the second front panel is connected to the front edge of the first top panel and disposed adjacent to the first front panel; and the first back panel is connected to the first bottom panel at the back edge of the first bottom panel.

12. The bag-in-box dispensing system of claim 11, wherein the outer box further comprises:

a second back panel connected to the first top panel at the back edge of the first top panel; and a second top panel connected to the top edge of the first side panel and adjacent to the first top panel.

13. The bag-in-box dispensing system of claim 11, wherein the second top panel is disposed adjacent to the first top panel.

14. The bag-in-box dispensing system of claim 11, wherein the box comprises one or more handle perforations in each of the first and second side panels.

15. The bag-in-box dispensing system of claim 1, wherein:

the first bottom panel comprises a front edge and a back edge; the first top panel comprises a front edge and a back edge;

the first bottom panel is connected to the bottom edge of the second side panel and is connected to the bottom edge of the first side panel;

the first top panel is connected to the top edge of the first side panel; the first front panel is connected to the front edge of the first bottom panel; the second front panel is connected to the front edge of the first top panel and disposed adjacent to the first front panel; and the first back panel is connected to the first bottom panel at the back edge of the first bottom panel.

16. The bag-in-box dispensing system of claim 15, wherein the outer box further comprises:

a second back panel connected to the first top panel at the back edge of the first top panel; and a third side panel connected to the second side edge of the first top panel and adjacent to the second side panel.

17. The bag-in-box dispensing system of claim 15, wherein the box comprises one or more handle perforations in each of the first and second side panels.

18. The bag-in-box dispensing system of claim 1, wherein:

the first bottom panel comprises a front edge and a back edge; the first top panel comprises a front edge and a back edge;

the first bottom panel is connected to the bottom edge of the second side panel and is connected to the bottom edge of the first side panel;

the first top panel is connected to the top edge of the first side panel; the first front panel is connected to the front edge of the first bottom panel; the second front panel is connected to the front edge of the first top panel and disposed adjacent to the first front panel; and the first back panel is connected to the first bottom panel at the back edge of the first bottom panel.

19. The bag-in-box dispensing system of claim 18, wherein the outer box further comprises:

a second back panel connected to the first top panel at the back edge of the first top panel; and a second top panel connected to the top edge of the second side panel and adjacent to the first top panel.

20. The bag-in-box dispensing system of claim 18, wherein the box comprises one or more handle perforations in each of the first and second top panels.

21. The bag-in-box dispensing system of claim 1, wherein the inner flexible container contains a pourable material; and comprises a pouring spout fitment attached to the flexible container, the pouring spout fitment comprising:

(1) a hollow rigid member comprising a top end having a discharge opening and a base end having a base end opening, an inner surface defining an inner space extending between the discharge opening and the base end opening, and an outer surface, (2) an extendible spout at least partially disposed in the hollow rigid member and connected to the hollow rigid member, the extendible spout comprising:

a proximal end and a proximal opening, the proximal end connected to the base end of the hollow rigid member, a distal end and a distal opening, the distal end configured to extend from and retract at least partially into the hollow rigid member, a discharge passage that extends from the proximal opening to the distal opening, and a duck bill valve disposed in the discharge passage, wherein the extendible spout is configured to dispense the pourable material from the container through the distal opening when the hollow rigid member is attached to the friction fit opening, and wherein the perforation is configured to allow a user to remove at least a portion of the pouring spout fitment so that it extends beyond the front panel.

22. The bag-in-box dispensing system of claim 21, wherein the substantially circular perforation is configured to secure a portion of the hollow rigid member of the pouring spout fitment.

23. The bag-in-box dispensing system of claim 1, wherein the outer box is made from a corrugated material.

24. A method of using a bag-in-box dispensing system, wherein the method comprises:

providing a bag-in-box dispensing system comprising:

an outer box enclosing an inner flexible container including a fitment, wherein the outer box comprises:

a top panel;

a bottom panel opposite the top panel;

a first side panel comprising a top edge, a bottom edge, a front edge, and a back edge;

a second side panel opposite the first side panel comprising a top edge, a bottom edge, a front edge, and a back edge;

a first front panel comprising a substantially circular perforation, a first flap perforation, and a second flap perforation configured to allow a user to separate a portion of the front panel, expose the dispensing system, and secure a portion of the dispensing system in the substantially circular perforation;

a second front panel disposed adjacent to the first front panel, such that the second front panel forms the outer surface of the box, wherein the second front panel comprises a perforation extending from an edge of the second front panel and configured to allow a portion of the second front panel to be removed, thereby exposing the substantially circular perforation and the first and second flap perforations of the first front panel; and a first back panel opposite the first and second front panels;

separating one or more handle perforations;

separating the perforation in the second front panel to expose the substantially circular perforation and the first and second flap perforations of the first front panel;

separating the substantially circular perforation in the first front panel; separating the first and second flap perforations in the first front panel; removing the fitment of the flexible container from the outer box and placing the fitment in the substantially circular perforation;

rejoining the first and second flap perforations, so that the substantially circular perforation may operate to keep the fitment fixed within the outer box; and dispensing a pourable material through the fitment.

* * * * *